US008428489B2

(12) United States Patent
Sameshima et al.

(10) Patent No.: US 8,428,489 B2
(45) Date of Patent: Apr. 23, 2013

(54) IMAGE FORMING APPARATUS COMPONENT POSITIONING MECHANISM

(75) Inventors: Junichirou Sameshima, Kanagawa (JP); Toshikazu Tsumita, Kanagawa (JP); Takeshi Okoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/603,120

(22) Filed: Sep. 4, 2012

(65) Prior Publication Data

US 2012/0328333 A1 Dec. 27, 2012

Related U.S. Application Data

(62) Division of application No. 12/105,547, filed on Apr. 18, 2008, now Pat. No. 8,280,276.

(30) Foreign Application Priority Data

Aug. 21, 2007 (JP) ..... 2007-214804

(51) Int. Cl.
*G03G 15/00* (2006.01)

(52) U.S. Cl.
USPC ..... 399/110; 399/113; 399/118; 399/119; 399/203; 399/205; 399/234

(58) Field of Classification Search ..... 399/110, 399/90, 113, 118–119, 151–152, 177, 203, 399/205, 222, 228, 234, 411
See application file for complete search history.

(56) References Cited

U.S. PATENT DOCUMENTS

| | | | | |
|---|---|---|---|---|
| 6,577,831 | B1 | 6/2003 | Kojima et al. | |
| 7,209,681 | B2 * | 4/2007 | Yamada et al. | 399/119 |
| 7,526,228 | B2 | 4/2009 | Shiraki | |
| 7,684,725 | B2 * | 3/2010 | Suyama et al. | 399/98 |
| 7,693,478 | B2 | 4/2010 | Tanaka et al. | |
| 7,804,511 | B2 * | 9/2010 | Honobe et al. | 347/149 |
| 8,005,397 | B2 * | 8/2011 | Sato | 399/111 |
| 8,068,762 | B2 * | 11/2011 | Yamaguchi | 399/110 |
| 8,078,085 | B2 * | 12/2011 | Okabe | 399/205 |
| 8,112,013 | B2 * | 2/2012 | Ikezaki | 399/107 |
| 8,157,462 | B2 * | 4/2012 | Hirabayashi | 400/693.1 |
| 8,170,447 | B2 * | 5/2012 | Kubo et al. | 399/118 |
| 8,280,276 | B2 * | 10/2012 | Sameshima et al. | 399/110 |
| 2007/0286632 | A1 * | 12/2007 | Okabe | 399/90 |
| 2009/0047041 | A1 | 2/2009 | Kubo et al. | |
| 2009/0052960 | A1 | 2/2009 | Tanaka et al. | |
| 2009/0220250 | A1 | 9/2009 | Funahashi | |
| 2010/0178076 | A1 * | 7/2010 | Okabe | 399/116 |
| 2011/0076050 | A1 * | 3/2011 | Okabe | 399/90 |

(Continued)

FOREIGN PATENT DOCUMENTS

| | | | |
|---|---|---|---|
| JP | 4-212973 | A | 8/1992 |
| JP | 4212973 | A | 8/1992 |
| JP | 2000-293085 | A | 10/2000 |
| JP | 2001-175046 | A | 6/2001 |

*Primary Examiner* — David Gray
*Assistant Examiner* — Geoffrey Evans
(74) *Attorney, Agent, or Firm* — Sughrue Mion, PLLC

(57) ABSTRACT

An image forming apparatus includes: an image carrier; a latent-image forming device; a developing device; a latent-image forming device contacting/separating mechanism; and a developing device contacting/separating mechanism, and the latent-image forming device contacting/separating mechanism allows the latent-image forming device to be movable to the latent-image forming device contacting position in a state where the developing device is moved to the developing device contacting position.

7 Claims, 22 Drawing Sheets

U.S. PATENT DOCUMENTS

2011/0116831 A1 5/2011 Honobe et al.
2011/0157295 A1* 6/2011 Sakamoto ..... 347/224
2011/0176829 A1 7/2011 Kobayashi
2011/0236073 A1 9/2011 Komatsu et al.
2011/0262183 A1* 10/2011 Seto et al. ..... 399/117
2012/0099886 A1* 4/2012 Kim ..... 399/98

* cited by examiner

IMAGE FORMING APPARATUS COMPONENT POSITIONING MECHANISM

CROSS-REFERENCE TO RELATED APPLICATIONS

This is a Divisional of U.S. patent application Ser. No. 12/105,547 filed on Apr. 18, 2008, which claims priority under 35 USC 119 from Japanese Patent Application No. 2007-214804 filed on Aug. 21, 2007, the disclosures of which are hereby incorporated by reference in their entireties.

BACKGROUND

Technical Field

The present invention relates to an image forming apparatus.

SUMMARY

According to an aspect of the invention, there is provided an image forming apparatus comprising: an image carrier; a latent-image forming device that forms a latent image in a surface of the image carrier; a developing device that develops the latent image of the surface of the image carrier; a latent-image forming device contacting/separating mechanism that moves the latent-image forming device between a latent-image forming device contacting position where a part of the latent-image forming device is positioned with being contacted with a part of the image carrier, and a latent-image forming device separating position where the latent-image forming device is separated from the image carrier; and a developing device contacting/separating mechanism that moves the developing device between a developing device contacting position where a part of the developing device is positioned with being contacted with a part of the image carrier, and a developing device separating position where the developing device is separated from the image carrier, wherein the latent-image forming device contacting/separating mechanism performs at least one of (i) and (ii), wherein (i) is that the latent-image forming device contacting/separating mechanism allows the latent-image forming device to be movable to the latent-image forming device contacting position in a state where the developing device is moved to the developing device contacting position, and (ii) is that the latent-image forming device contacting/separating mechanism restricts the latent-image forming device from being moved to the latent-image forming device contacting position in a state where the developing device is moved to the developing device separating position.

BRIEF DESCRIPTION OF THE DRAWINGS

Exemplary embodiments of the present invention will be described in detail based on the following figures, wherein:

FIG. 3 is a view illustrating relationships of an image carrier, a latent-image forming device, and a developing device in the image forming apparatus of Example 1 of the invention.

FIG. 4 is a perspective diagram illustrating the latent-image forming device in Example 1.

FIG. 5 is a view illustrating an outer frame member of the latent-image forming device in Example 1.

FIG. 6 is a view illustrating the positional relationship of the latent-image forming device and the image carrier in Example 1.

FIG. 7 is a view illustrating main portions of a contacting/separating mechanism of the latent-image forming device in Example 1 in a state where illustration of a part of an outer frame member is omitted from the state shown in FIG. 4.

FIG. 8 is a view illustrating an operation coupling member of the latent-image forming device in Example 1.

FIG. 9 is a view illustrating a moving member of the latent-image forming device in Example 1.

FIG. 11 is a view illustrating a movement direction changing member of the latent-image forming device in Example 1.

FIG. 12 is a view illustrating the interlocking contacting member disposed in the latent-image forming device in Example 1.

FIG. 13 is a view illustrating an approaching/separating member of the latent-image forming device in Example 1.

FIG. 14 is a view illustrating an image writing beam irradiating unit of the latent-image forming device in Example 1.

FIG. 15 is a view illustrating the positional relationship of the image carrier in Example 1 and the latent-image forming device.

FIG. 16 is a view illustrating a function in the case where the latent-image forming device and the developing device in Example 1 are to be separated from the image carrier.

FIG. 17 is a view illustrating a function in the case where the latent-image forming device and the developing device in Example 1 are to be approached to the image carrier.

FIG. 19 is a view illustrating a latent-image forming device in Example 2.

FIG. 20 is a diagram of the image forming apparatus of Example 3.

FIG. 22 is a diagram of the image forming apparatus of Example 4.

DESCRIPTION OF REFERENCE NUMERALS AND SIGNS

Figure 1:
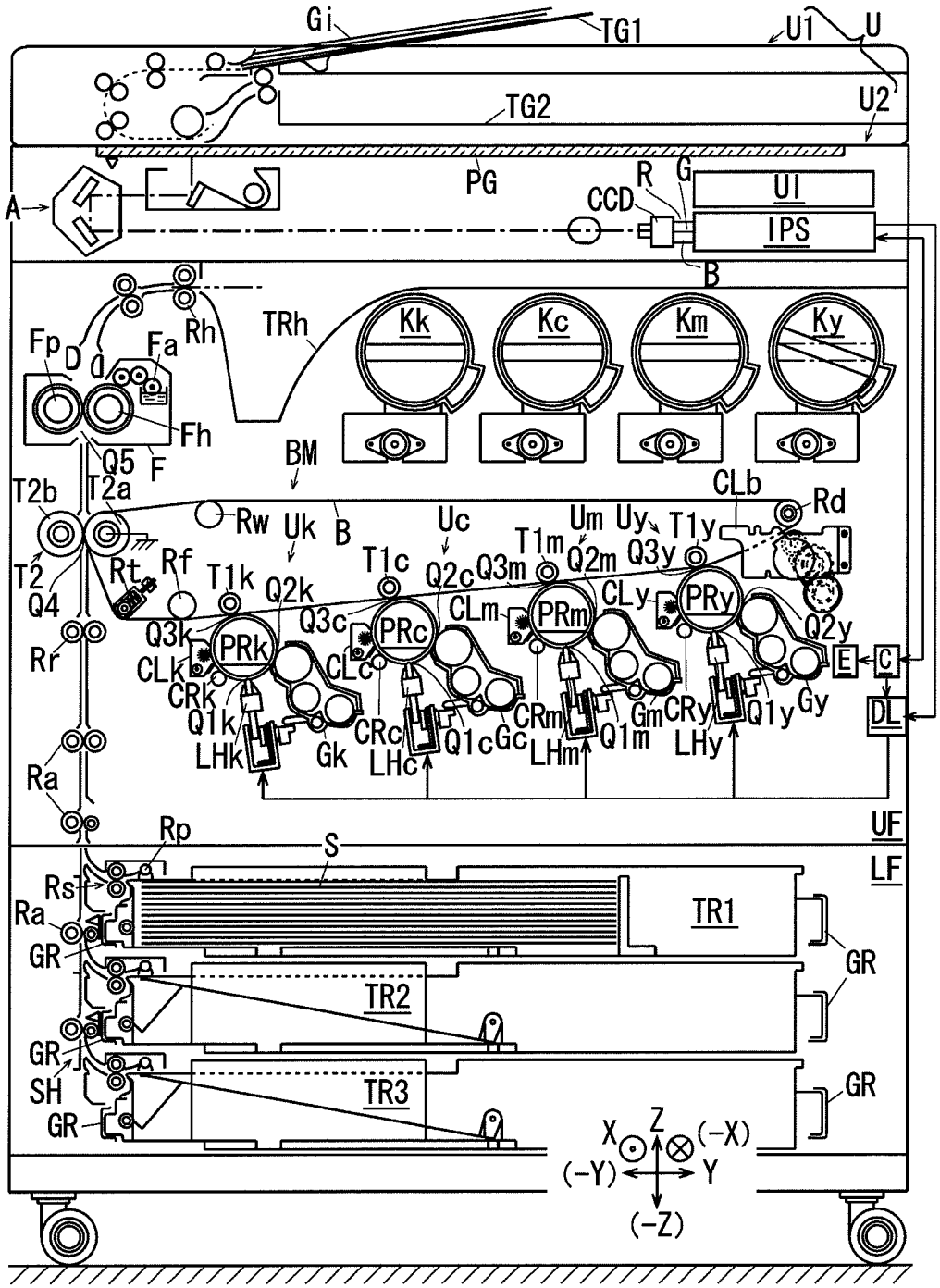
FIG. 1 is a diagram illustrating the whole of an image forming apparatus of Example 1 of the invention.

1 . . . developing container,
4 . . . developer holding member,
6 . . . swing shaft,
6+7 . . . developing device contacting/separating mechanism,
7 . . . developing device urging member,
8 . . . interlocking contacted member,
8+21 . . . interlocking mechanism,
11 . . . outer frame member,
11 to 22 . . . latent-image forming device contacting/separating mechanism,
12 . . . operating member,
14 . . . moving member,
17 . . . movement direction changing member,
21 . . . interlocking contacting member,
22 . . . approaching/separating member,
23*b* . . . light irradiating portion,
Gy, Gm, Gc, Gk . . . developing device,
LHy, LHm, LHc, LHk . . . latent-image forming device,
PRy, PRm, PRc, PRk . . . image carrier,
U . . . image forming apparatus.

DETAILED DESCRIPTION

Next, examples which are exemplary embodiments of the invention will be described with reference to the accompanying drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, -X, Y, -Y, Z, and -Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "x" is written in "○" indicates the arrow which is directed from the front of the sheet to the rear.

In the following description with reference to the drawings, illustrations of members other than those which are necessary in description are suitably omitted for the sake of easy understanding.

Example 1

FIG. 1 is a diagram illustrating the whole of an image forming apparatus of Example 1 of the invention.

Referring to FIG. 1, the image forming apparatus U comprises an automatic document conveying device U1, and an image forming apparatus body U2 which supports the device, and which has a transparent document reading face PG in the upper end.

The automatic document conveying device U1 has: a document feeding portion TG1 in which plural documents Gi to be copied are housed in a stacked manner; and a document discharging portion TG2 to which the documents Gi fed from the document feeding portion TG1 and passed through a document reading position on the document reading face PG are discharged.

The image forming apparatus body U2 has an operation portion UI through which the user inputs an operation command signal such as the start of an image forming operation, an exposing optical system A, etc.

Reflected light from a document which is conveyed on the document reading face PG by the automatic document conveying device U1, or that which is manually placed on the document reading face PG is passed through the exposing optical system A and converted by a solid-state imaging element CCD to electric signals of red R, green G, and blue B.

An image information converting portion IPS converts the electric signals of RGB to image information of black K, yellow Y, magenta M, and cyan C supplied from the solid-state imaging element CCD, temporarily stores the image information, and supplies the image information at a predetermined timing as image information for forming latent images, to a latent-image forming device driving circuit DL.

In the case where the document image is a single-color image or a so-called monochromatic image, only image information of black is supplied to the latent-image forming device driving circuit DL.

The latent-image forming device driving circuit DL has driving circuits (not shown) for the respective colors Y, M, C, and K, and supplies signals corresponding to the input image information at predetermined timings, to latent-image forming devices LHy, LHm, LHc, LHk which are disposed for the respective colors.

Figure 2:
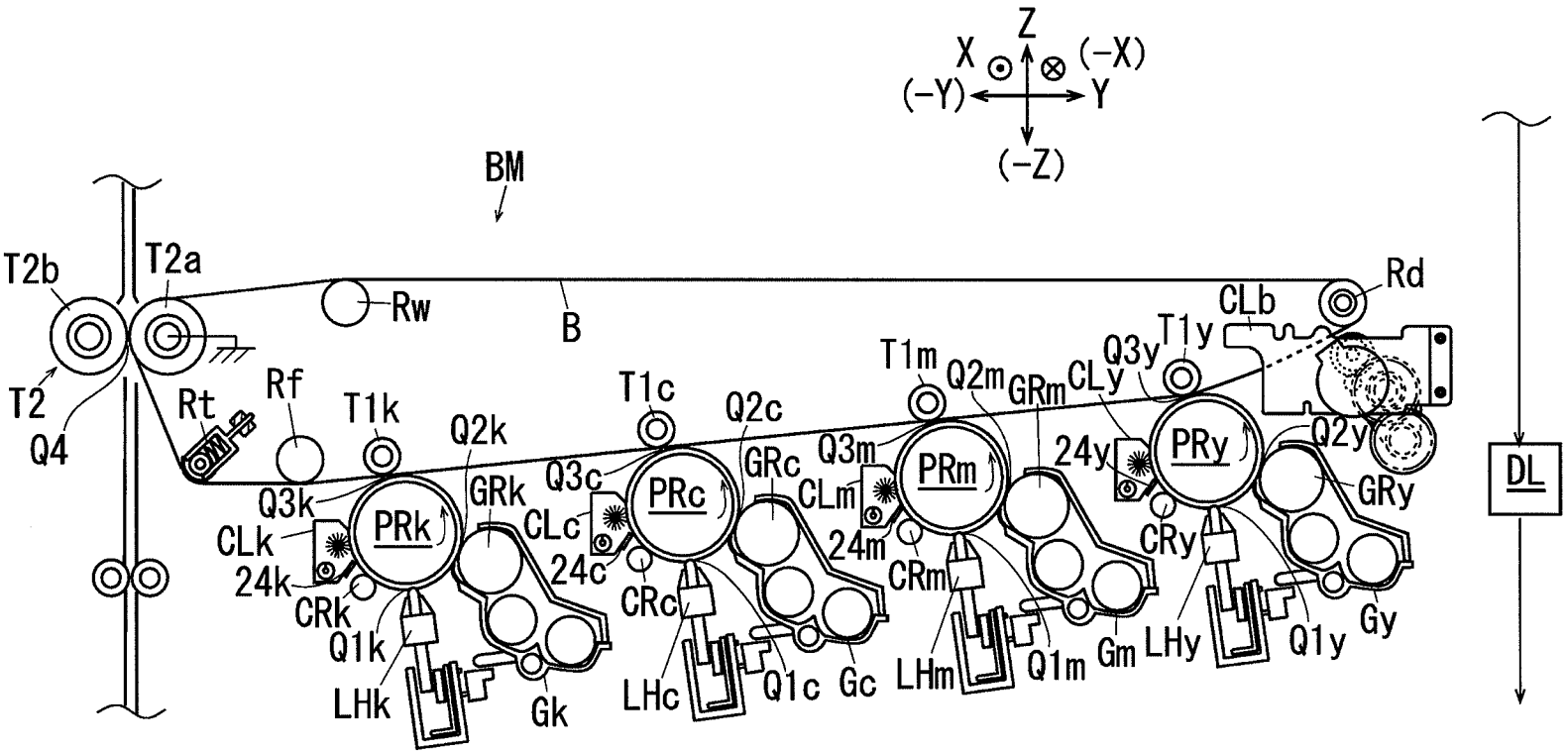
FIG. 2 is an enlarged view illustrating main portions of the image forming apparatus of Example 1.

FIG. 2 is an enlarged view illustrating main portions of the image forming apparatus of Example 1.

Visible-image forming devices Uy, Um, Uc, Uk which are placed in a middle portion in the gravitational direction of the image forming apparatus U form toner images of the colors of yellow Y, magenta M, cyan C, and black K, respectively.

Latent-image writing beams Ly, Lm, Lc, Lk of Y, M, C, and K emitted from laser diodes of the latent-image forming devices LHy to LHk impinge on rotary image carriers PRy, PRm, PRc, PRk, respectively. In Example 1, the latent-image forming devices LHy to LHk are configured by so-called LED arrays, respectively.

The image forming apparatus Uy for Y has the rotary image carrier PRy, a charging device CRy, the latent-image forming device LHy, a developing device Gy, a transferring device T1*y*, and an image-carrier cleaner CLy.

The visible-image forming devices Um, Uc, Uk are configured in a similar manner as the visible-image forming device Uy for Y.

Referring to FIGS. 1 and 2, the image carriers PRy, PRm, PRc, PRk are charged by the respective charging devices CRy, CRm, CRc, CRk, and, at image writing stations Q1*y*, Q1*m*, Q1*c*, Q1*k*, electrostatic latent images are then formed in their surfaces by the latent-image writing beams Ly, Lm, Lc, Lk. In developing regions Q2*y*, Q2*m*, Q2*c*, Q2*k*, the electrostatic latent images in the surfaces of the image carriers PRy, PRm, PRc, PRk are developed into toner images which are examples of visible images by developers held by developing rolls GRy, GRm, GRc, GRk which are examples of developer carriers of the developing devices Gy, Gm, Gc, Gk.

The developed toner images are conveyed to primary transferring regions Q3*y*, Q3*m*, Q3*c*, Q3*k* which are contacted with an intermediate transfer belt B that is an example of an intermediate transferring member. At a predetermined timing, a power source circuit E which is controlled by a controller C applies a primary transfer voltage in which the polarity is opposite to the charging polarity of the toner, to primary transferring devices T1*y*, T1*m*, T1*c*, T1*k* placed on the rear face side of the intermediate transfer belt B in the primary transferring regions Q3*y*, Q3*m*, Q3*c*, Q3*k*.

The toner images on the image carriers PRy to PRk are primarily transferred to the intermediate transfer belt B by the primary transferring devices T1*y*, T1*m*, T1*c*, T1*k*. Residual toners on the surfaces of the image carriers PRy, PRm, PRc, PRk after the primary transfer are cleaned by the image-carrier cleaners CLy, CLm, CLc, CLk. The surfaces of the image carriers PRy, PRm, PRc, PRk which have been cleaned are again charged by the charging devices CRy, CRm, CRc, CRk.

A belt module BM which is an example of an intermediate transferring device, and which is vertically movable and forward extractable is placed above the image carriers PRy to PRk. The belt module BM has: the intermediate transfer belt B which is an example of an intermediate-transferring member; a belt supporting roll Rd+Rt+Rw+Rf+T2*a* which is an intermediate-transferring member support member, and which includes a belt driving roll Rd that is an example of an intermediate-transferring member driving member, a tension roll Rt that is an example of an intermediate-transferring member stretching member, a walking roll Rw that is an example of a meandering preventing member, an idler roll Rf that is an example of a driven member, and a backup roll T2*a* that is an example of a secondary-transfer region opposing member; and the primary transferring devices T1*y*, T1*m*, T1*c*, T1*k*. The intermediate transfer belt B is supported in a rotary movable manner by the belt supporting roll Rd+Rt+Rw+Rf+T2*a*.

A secondary transfer roll T2*b* which is an example of a secondary transfer member is placed while opposing to the surface of the intermediate transfer belt B contacted with the backup roll T2*a*. A secondary transferring device T2 is configured by the rolls T2*a*, T2*b*. A secondary transferring region Q4 is formed in a region where the secondary transferring device T2*b* and the intermediate transfer belt B are opposed to each other.

The single- or multi-color toner images which are sequentially stackingly transferred onto the intermediate transfer belt B by the transferring devices T1*y*, T1*m*, T1*c*, T1*k* in the primary transferring regions Q3*y*, Q3*m*, Q3*c*, Q3*k* are conveyed to the secondary transferring region Q4.

Three pairs of right and left guide rails GR, GR which are examples of a guiding member for retractably supporting sheet feeding trays TR1 to TR3 that are examples of a sheet feeding container, so as to be extractable and retractable in the front and rear directions (X-axis direction) are disposed below the visible-image forming devices Uy to Uk. Recording sheets S which are examples of media housed in the sheet feeding trays TR1 to TR3 are taken out by a pickup roll Rp which is an example of a medium taking out member, and separated one by one by a separating roll Rs which is an example of a medium separating member. Then, the recording sheet is conveyed by plural conveying rolls Ra which are examples of a medium conveying member, along a sheet conveying path SH which is an example a medium conveying path, and sent to a registration roll Rr which is an example a transfer-region conveyance timing adjusting member, and which is disposed on the upstream side of the secondary transferring region Q4 in the sheet conveying direction. A sheet conveying device SH+Ra+Rr is configured by the sheet conveying path SH, the sheet conveying rolls Ra, the registration roll Rr, etc.

The registration roll Rr conveys the recording sheet S to the secondary transferring region Q4 in timing with the conveyance of the toner image formed on the intermediate transfer belt B to the secondary transferring region Q4. When the recording sheet S is passed through the secondary transferring region Q4, the backup roll T2*a* is grounded, and the power source circuit E which is controlled by the controller C applies a secondary transfer voltage which is opposite to the charging polarity of the toner, to the secondary transferring device T2*b* at a predetermined timing. At this time, the color toner image on the intermediate transfer belt B is transferred to the recording sheet S by the secondary transferring device T2.

After the secondary transfer, the intermediate transfer belt B is cleaned by a belt cleaner CLb which is an example of an intermediate-transferring member cleaner.

The recording sheet S onto which the toner image has been secondarily transferred is conveyed to a fixing region Q5 which is a press contact region between a heating roll Fh that is an example of a heating fixing member of a fixing device F, and a pressuring roll Fp that is an example of a pressuring fixing member, and subjected to heating fixation when passed through the fixing region. The recording sheet S which has undergone heating fixation is discharged to a discharge tray TRh which is an example of a medium discharging portion, from a discharging roller Rh which is an example of a medium discharging member.

A release agent which improves the property of releasing of the recording sheet S from the heating roll is applied to the surface of the heating roll Fh by a release-agent applying device Fa.

Developer cartridges Ky, Km, Kc, Kk which are examples of developer replenishment containers respectively housing developers of yellow Y, magenta M, cyan C, and black K are arranged above the belt module BM. The developers housed in the developer cartridges Ky, Km, Kc, Kk are replenished to the developing devices Gy, Gm, Gc, Gk in accordance with consumptions of the developers of the developing devices Gy, Gm, Gc, Gk, through developer replenishment paths which are not shown. In Example 1, each developer is configured by a two-component developer containing a magnetic carrier, and a toner to which an external additive is added.

Referring to FIG. 1, the image forming apparatus U has an upper frame UF and a lower frame LF. The upper frame UF supports the visible-image forming devices Uy to Uk and the components which are placed above the visible-image forming devices Uy to Uk, i.e., the belt module BM, etc.

The lower frame LF supports the guide rails GR supporting the sheet feeding trays TR1 to TR3, the sheet feeding members which feed sheets from the trays TR1 to TR3, i.e., the pickup roll Rp, the separating roll Rs, the sheet conveying rolls Ra, etc.

(Description of Members of Visible-Image Forming Devices)

Figure 3A:
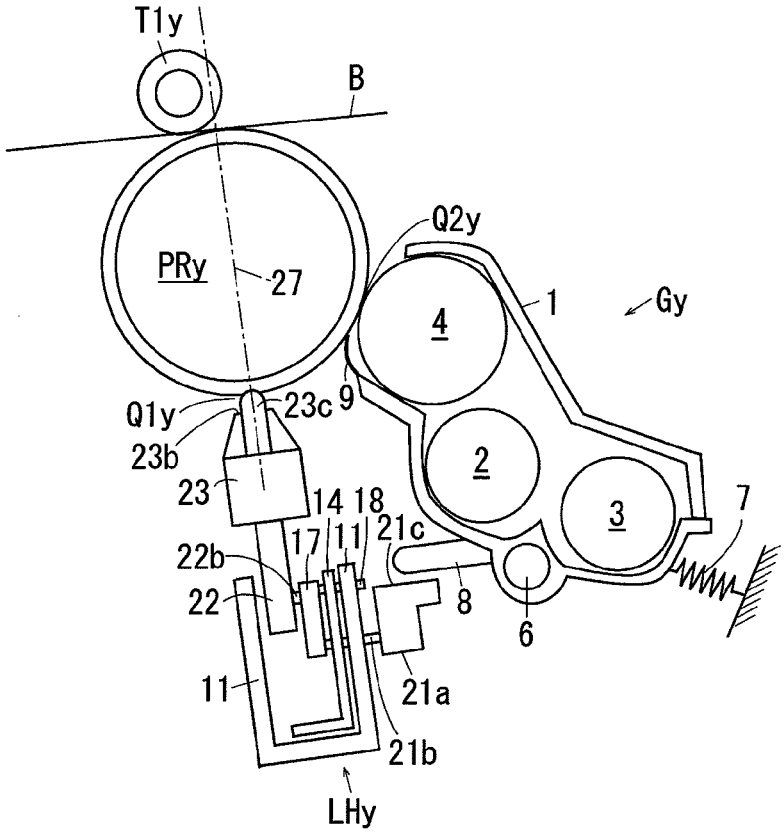
FIG. 3A is a diagram of a state where the developing device is moved to a developing device contacting position, and the latent-image forming device is moved to a latent-image forming device contacting position.
Figure 3B:
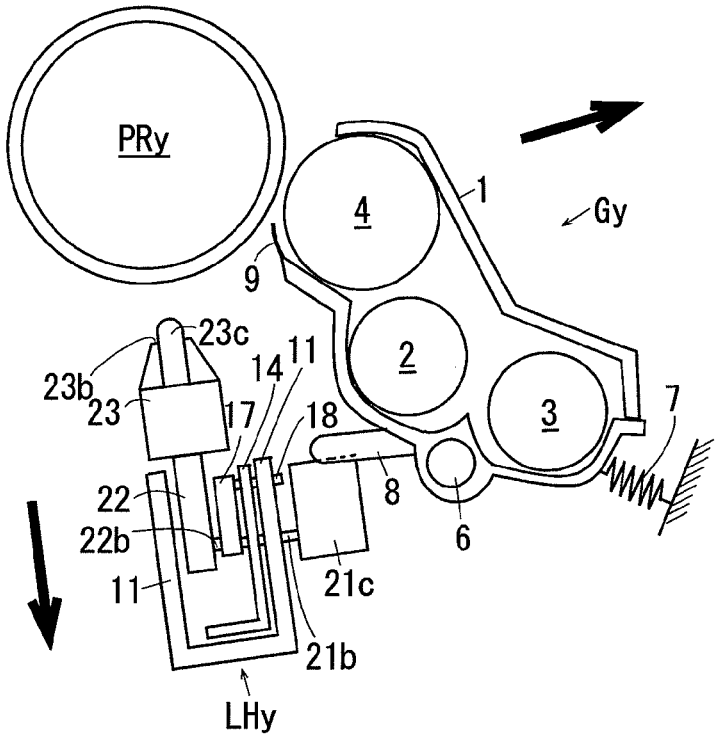
FIG. 3B is a diagram of a state where the developing device is moved to a developing device separating position, and the latent-image forming device is moved to a latent-image forming device separating position.

FIG. 3 is a view illustrating relationships of the image carrier, the latent-image forming device, and the developing device in the image forming apparatus of Example 1 of the invention, FIG. 3A is a diagram of a state where the developing device is moved to a developing device contacting position, and the latent-image forming device is moved to a latent-image forming device contacting position, and FIG. 3B is a diagram of a state where the developing device is moved to a developing device separating position, and the latent-image forming device is moved to a latent-image forming device separating position.

Next, the developing devices Gy, Gm, Gc, Gk and latent-image forming devices LHy, LHm, LHc, LHk which constitute the visible-image forming devices Uy, Um, Uc, Uk in Example 1 of the invention will be described. Since the members for the respective colors are configured in the same manner, only those for Y color will be described, and detailed description of the members for the other colors will be omitted.

(Description of Developing Device)

Referring to FIG. 3, the developing device Gy in Example 1 has a developing container 1 in which a developer is housed. A pair of stirring conveying members 2, 3 which convey the developer in the container while stirring the developer are rotatably supported in the developing container 1. A developer holding member 4 which holds the developer stirred by the stirring conveying members 2, 3 to the surface, and which conveys the developer to the developing region Q2*y* that is a region opposed to the image carrier PRy is rotatably supported in the developing container 1.

Referring to FIG. 3, the developing container 1 is swingably supported about a swing shaft 6 on a frame member which is not shown, or a so-called frame of a developing unit. One end of a developing device urging member 7 which always urges the developer holding member 4 toward the image carrier PRy is supported on the outer wall of the developing container 1 which is opposite to the image carrier PRy with respect to the swing shaft 6. Therefore, the developer holding member 4 receives a force in a direction along which the member is always pressed toward the image carrier PRy. The distance between the developer holding member 4 and the image carrier PRy is held to a predetermined value by developing-region butting portions (not shown) or so-called tracking portions which are placed in the both end portions of the developer holding member 4, and which function as developing device positioning portions in the developer holding member 4. In a normal state, namely, the developing device Gy is held to the developing device contacting position shown in FIG. 3A. When an external force causing the developing device Gy to rotate in the direction along which it is separated from the image carrier PRy is applied, the developing device Gy is separated from the image carrier PRy against the force of the developing device urging member 7. Namely, a developing device contacting/separating mechanism (6+7) in Example 1 is configured by the swing shaft 6 and the developing device urging member 7.

An interlocking contacted member 8 which extends toward the latent-image forming device LHy is supported on the outer wall of the developing container 1 on the side of the latent-image forming device LHy. Furthermore, a leakage preventing member 9 which is in contact with the surface of the image carrier PRy to prevent the developer from downward leaking is supported below the developer holding member 4 of the developing container 1.

(Description of Latent-Image Forming Device)

Figure 4A:
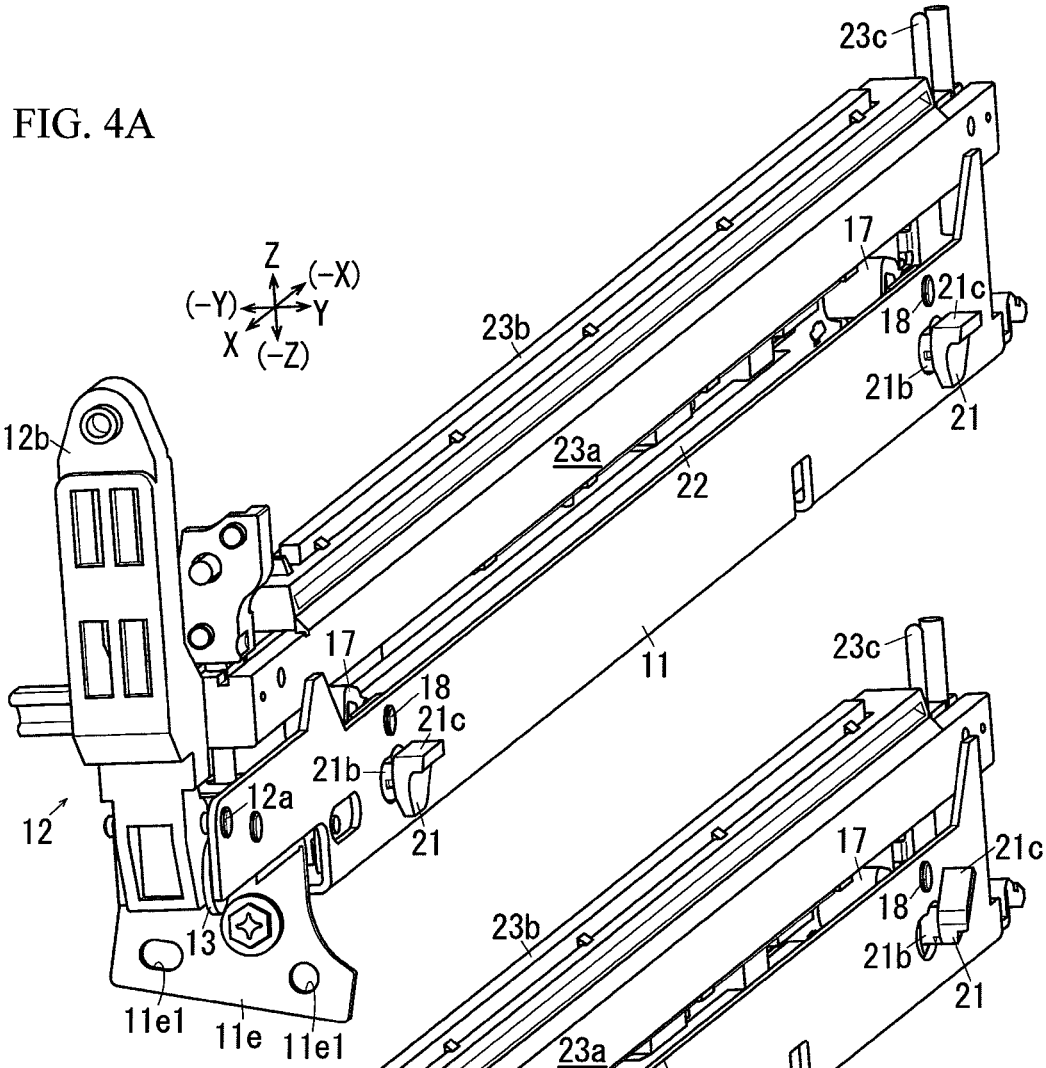
FIG. 4A is a view illustrating a state where the latent-image forming device is moved to the latent-image forming device contacting position.
Figure 4B:
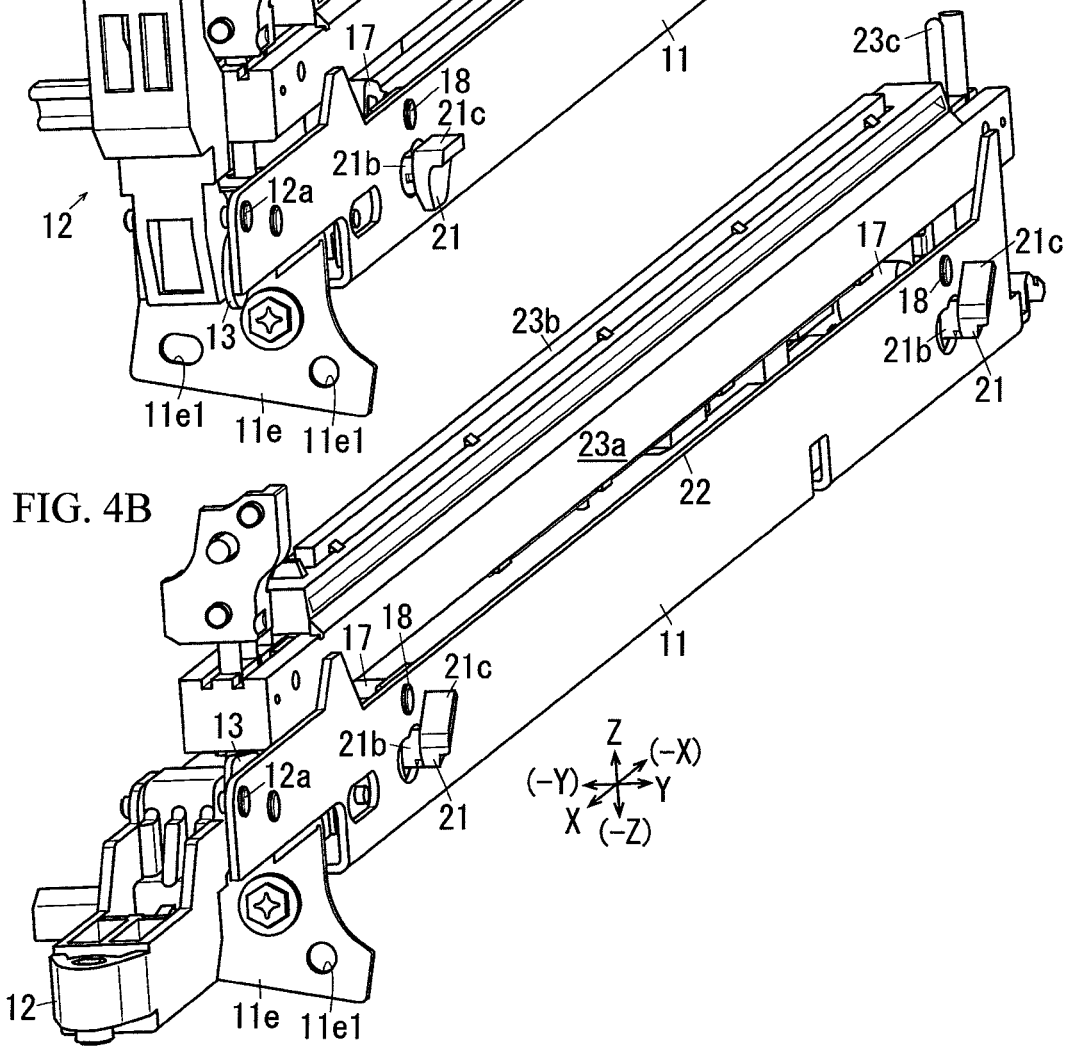
FIG. 4B is a view illustrating a state where the latent-image forming device is moved to the latent-image forming device separating position.

FIG. 4 is a perspective diagram illustrating the latent-image forming device in Example 1, FIG. 4A is a view illustrating a state where the latent-image forming device is moved to the latent-image forming device contacting position, and FIG. 4B is a view illustrating a state where the latent-image forming device is moved to the latent-image forming device separating position.

Figure 5A:
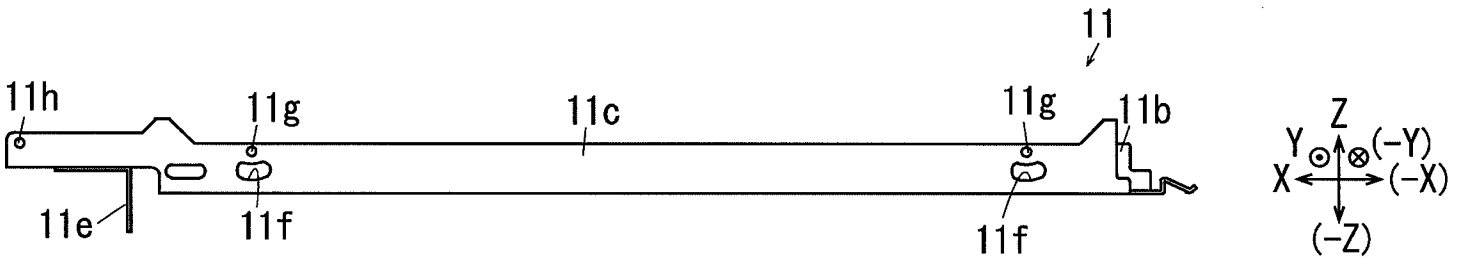
FIG. 5A is a plan view.
Figure 5B:
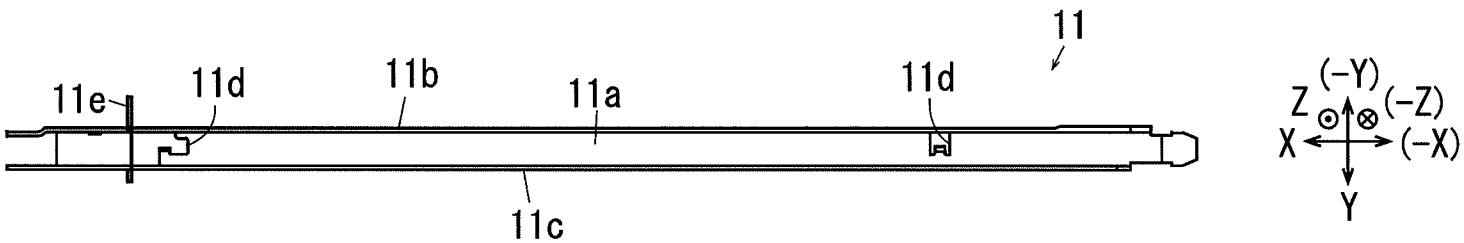
FIG. 5B is a side view.

FIG. 5 is a view illustrating an outer frame member of the latent-image forming device in Example 1, FIG. 5A is a plan view, and FIG. 5B is a side view.

Referring to FIG. 4, the latent-image forming device LHy in Example 1 has an outer frame member 11 which is fixed and supported on the image forming apparatus body U2 by means of screws. Referring to FIG. 5, the outer frame member 11 has: a bottom wall 11*a* which extends in the front and rear directions that coincide with the axial direction of the image carrier PRy; and left and right side walls 11*b*, 11*c* which upward extend from the left and right ends of the bottom wall 11*a*, respectively. A pair of urging member end supporting portions 11*d* having a hole-like shape are formed in front and rear end portions of the bottom wall 11*a*.

Referring to FIGS. 4 and 5, a fixed portion lie which downward extends is formed on the lower faces of front end portions of the left and right side walls 11*b*, 11*c*, and screwed to the image forming apparatus body U2 through holes 11*e*1 formed in the fixed portion 11*e*. A pair of front and rear interlocking contacting member outer passing portions 11*f* are formed in the right side wall 11*c*. Each of the interlocking contacting member outer passing portions 11*f* in Example 1 is configured by an arcuate oblong hole. A pair of front and rear swing shaft supporting portions 11*g* are formed above the interlocking contacting member outer passing portions 11*f*. A pair of left and right operating member supporting portions 11*h* are formed in front end portions of the left and right side walls 11*b*, 11*c*. Each of the operating member supporting portions 11*h* in Example 1 is configured by a through hole.

Figure 6A:
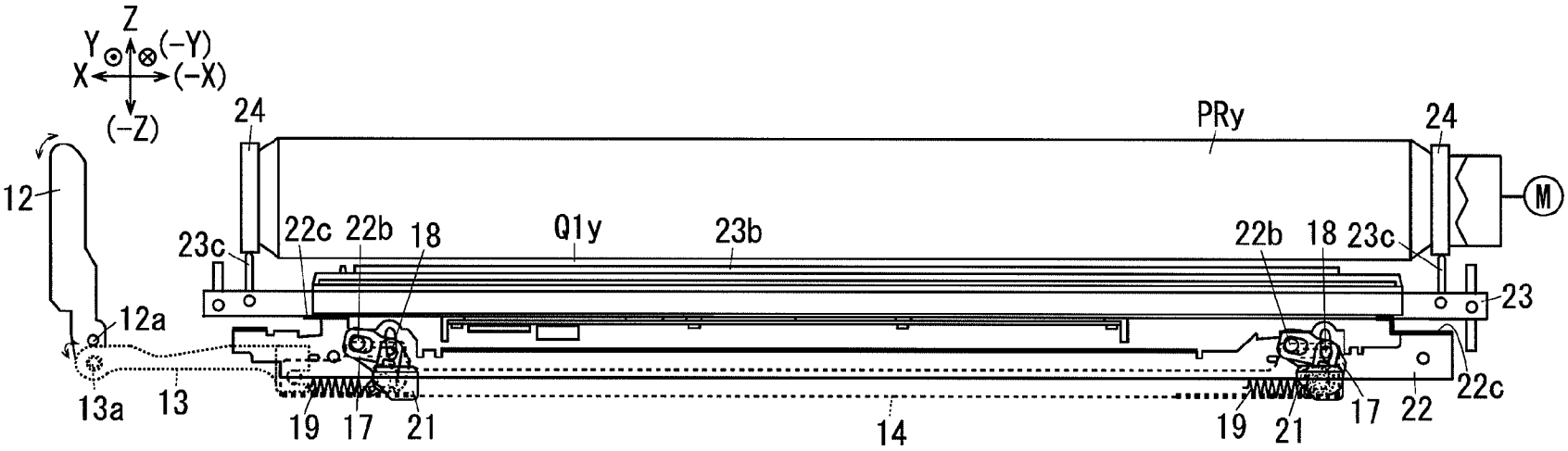
FIG. 6A is a view illustrating a state where the latent-image forming device is moved to the latent-image forming device contacting position.
Figure 6B:
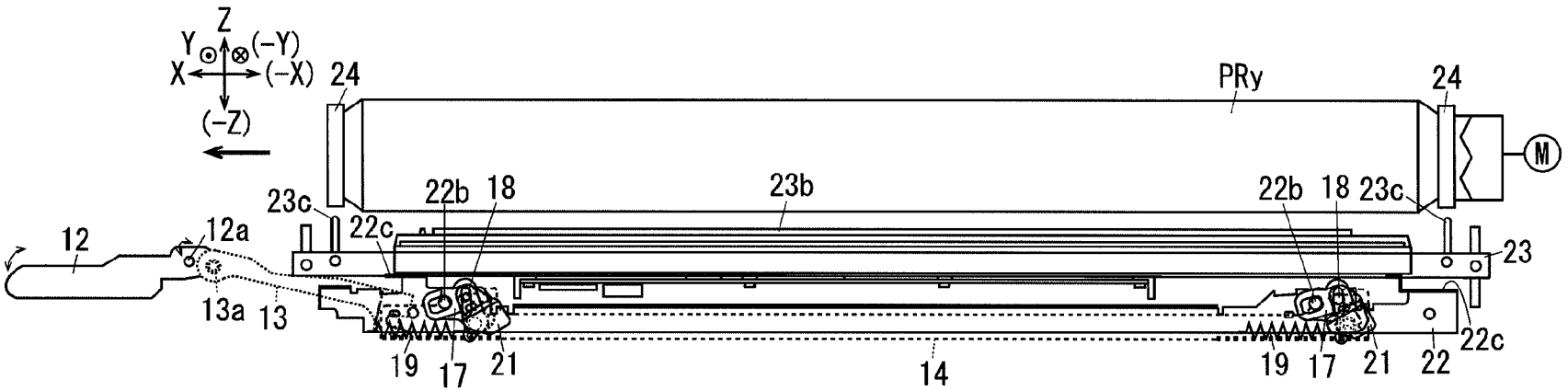
FIG. 6B is a view illustrating a state where the latent-image forming device is moved to the latent-image forming device separating position.

FIG. 6 is a view illustrating the positional relationship of the latent-image forming device and the image carrier in Example 1, FIG. 6A is a view illustrating a state where the latent-image forming device is moved to the latent-image forming device contacting position, and FIG. 6B is a view illustrating a state where the latent-image forming device is moved to the latent-image forming device separating position.

Figure 7A:
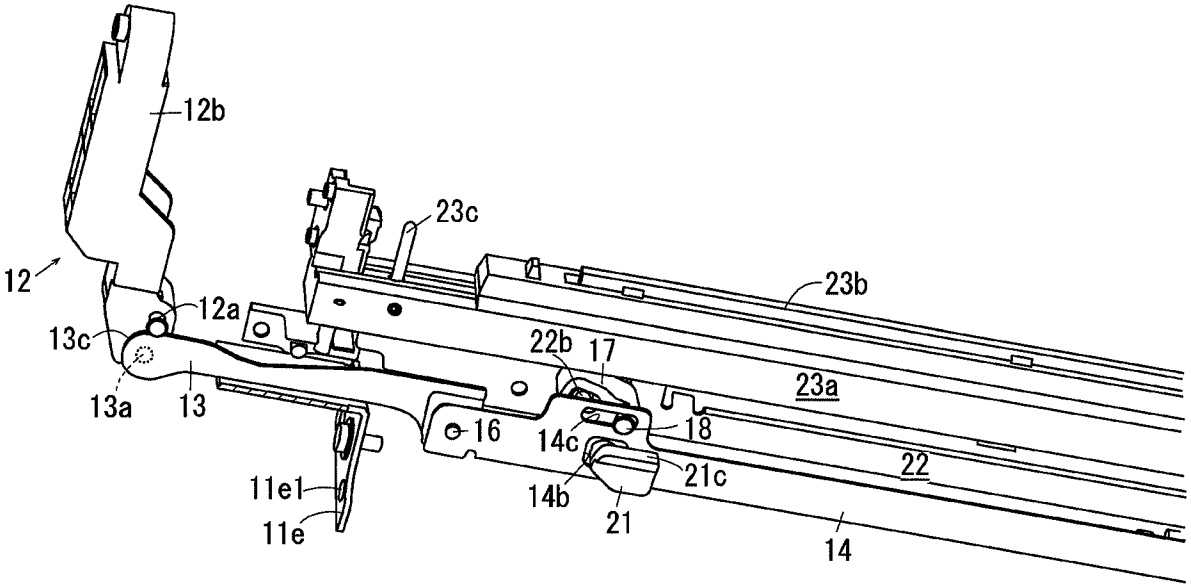
FIG. 7A is a view illustrating a state where the device is moved to the latent-image forming device contacting position.
Figure 7B:
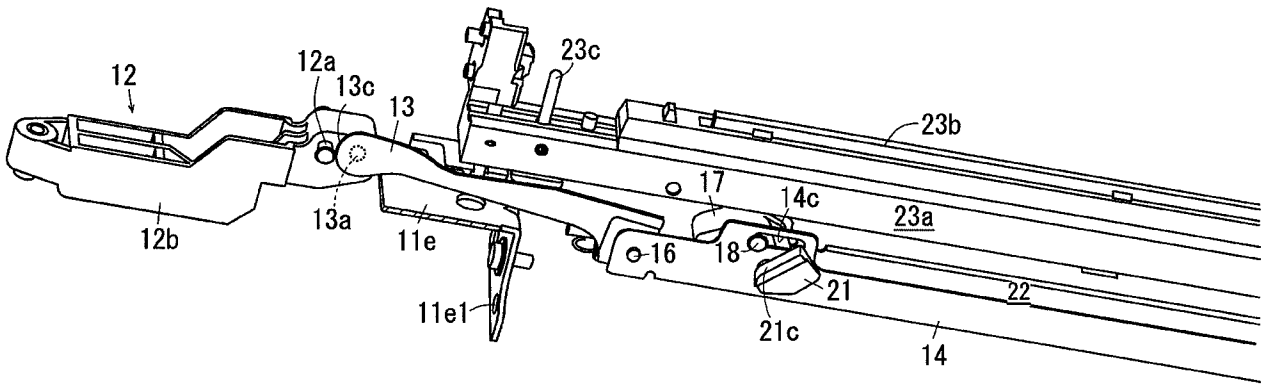
FIG. 7B is a view illustrating a state where the device is moved to the latent-image forming device separating position.

FIG. 7 is a view illustrating main portions of a contacting/separating mechanism of the latent-image forming device in Example 1 in a state where illustration of a part of the outer frame member is omitted from the state shown in FIG. 4, FIG. 7A is a view illustrating a state where the device is moved to the latent-image forming device contacting position, and FIG. 7B is a view illustrating a state where the device is moved to the latent-image forming device separating position.

Referring to FIGS. 4 and 7, an operating member 12 is supported by the operating member supporting portions 11*h* of the outer frame member 11 so as to be swingable about a swing shaft member 12*a* of the operating member 12. The operating member 12 has a grip portion 12*b* which is to be operated with being gripped by the user, and supported so that, when the grip portion 12*b* is gripped and operated, the operating member 12 is movable between a normal position where the member is upward swung as shown in FIGS. 4A, 6A, and 7A, and an insertion/extraction enabled position where the member is forward swung as shown in FIGS. 4B, 6B, and 7B. In Example 1, as shown in FIG. 6A, the operating member 12 is configured so that, at the normal position, the grip portion 12*b* is placed in front of the image carrier PRy in the axial direction, and the axial movement of the image carrier PRy, i.e., attachment and detachment of the image carrier PRy with respect to the image forming apparatus body U2 are restricted.

Figure 8A:
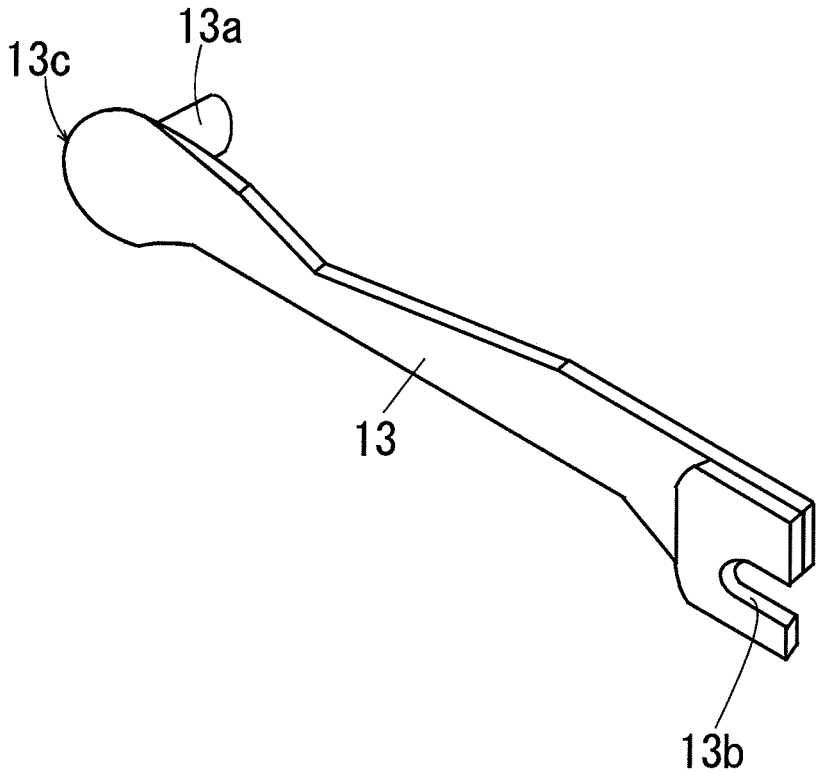
FIG. 8A is a perspective view.
Figure 8B:
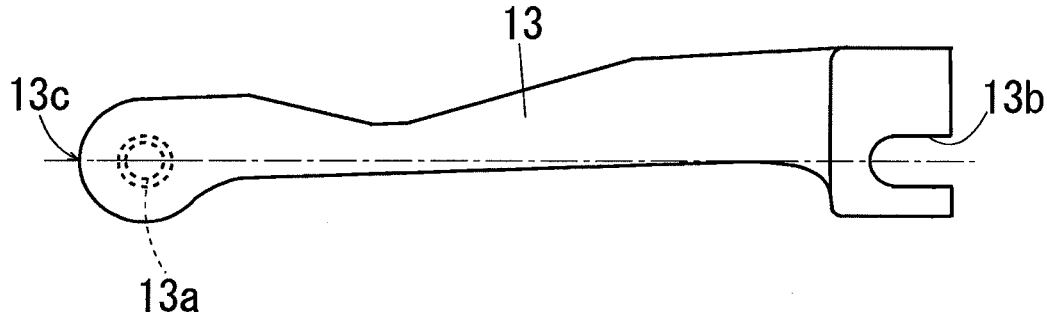
FIG. 8B is a side view.

FIG. 8 is a view illustrating an operation coupling member of the latent-image forming device in Example 1, FIG. 8A is a perspective view, and FIG. 8B is a side view.

Referring to FIG. 4, the operation coupling member 13 which is contacted with the swing shaft member 12*a* is placed between the right side wall 11*c* of the outer frame member 11 and the operating member 12. Referring to FIGS. 7 and 8, the operation coupling member 13 is configured by a coupling arm which extends in the front and rear directions, and a swung supporting portion 13*a* which is swingably supported by the operating member 12 is formed in a front end portion. Referring to FIG. 7, a depressed shaft coupling recess 13*b* is formed in a rear end portion of the operation coupling member 13. A dead center 13*c* is set on an extension of a phantom line which connects the arc enter of the arcuate portion of the shaft coupling recess 13*b* with the center of the swung supporting portion 13*a*. As shown in FIGS. 6 and 7, the dead center is set so that, on the way of movement of the operating member 12 between the normal position and the insertion/extraction enabled position, the swing shaft member 12*a* of the operating member 12 passes through the dead center 13*c*, i.e., the position where the arc enter of the arcuate portion of the shaft coupling recess 13*b*, the center of the swung supporting portion 13*a*, and that of the swing shaft member 12*a* are on a straight line.

Figure 9A:
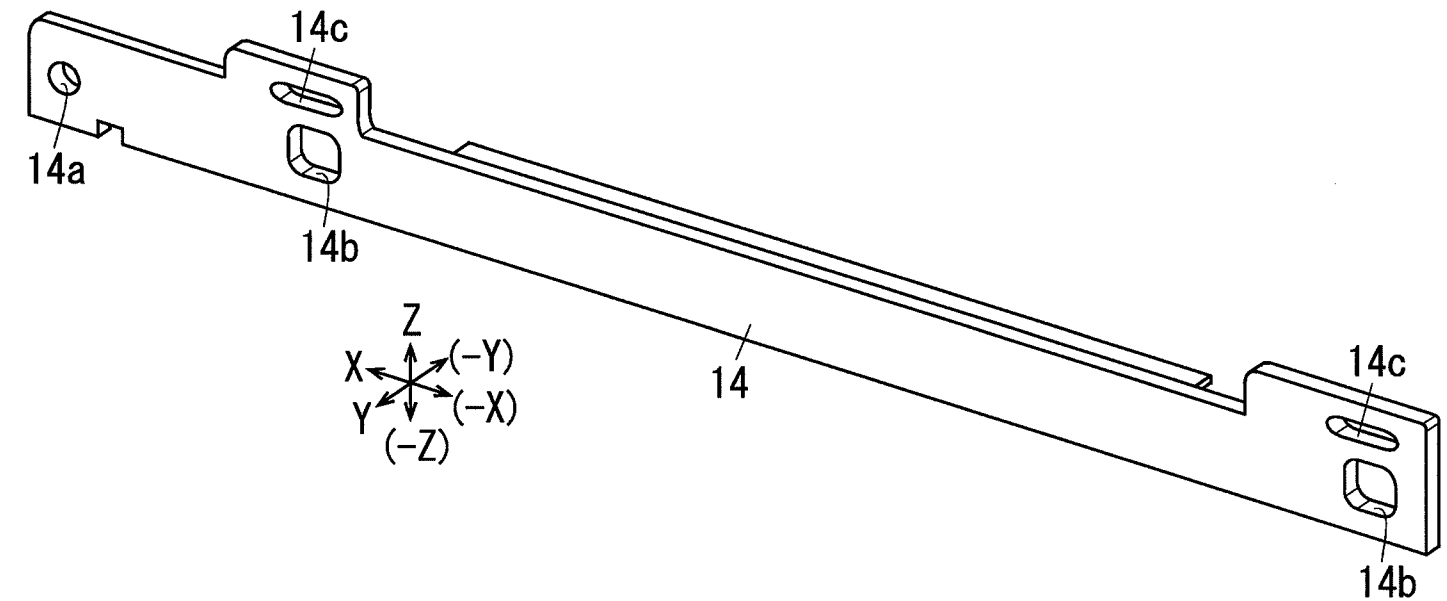
FIG. 9A is a perspective view.
Figure 9B:
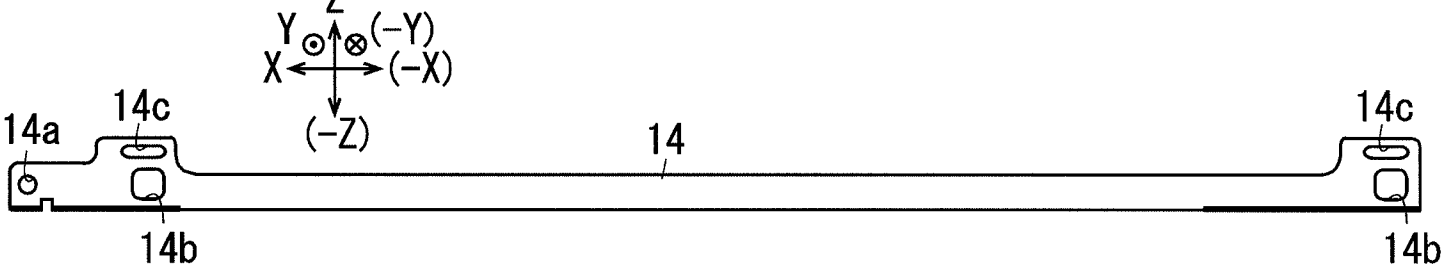
FIG. 9B is a side view.

FIG. 9 is a view illustrating a moving member of the latent-image forming device in Example 1, FIG. 9A is a perspective view, and FIG. 9B is a side view.

Referring to FIGS. 7 and 9, the moving member 14 is placed on the side of the rear end of the operation coupling member 13. The moving member 14 is accommodated in the outer frame member 11, and supported so as to be movable in the front and rear directions. In a front end portion of the moving member 14, a shaft supporting portion 14*a* is formed correspondingly with the shaft coupling recess 13*b* of the operation coupling member 13. A coupling shaft 16 shown in FIG. 7 is supported by the shaft supporting portion 14*a*, and fitted into the shaft coupling recess 13*b*, thereby coupling the members with each other.

Referring to FIGS. 7 and 9, a pair of front and rear interlocking contacting member inner passing portions 14*b* respectively configured by rectangular holes are formed correspondingly with the interlocking contacting member outer passing portions 11*f* of the outer frame member 11. Above the interlocking contacting member inner passing portions 14*b*, a pair of front and rear direction changing swing shaft passing portions 14*c* respectively configured by oblong holes which extend in the front and rear directions are formed correspondingly with the swing shaft supporting portions 11*g*.

Figure 10:
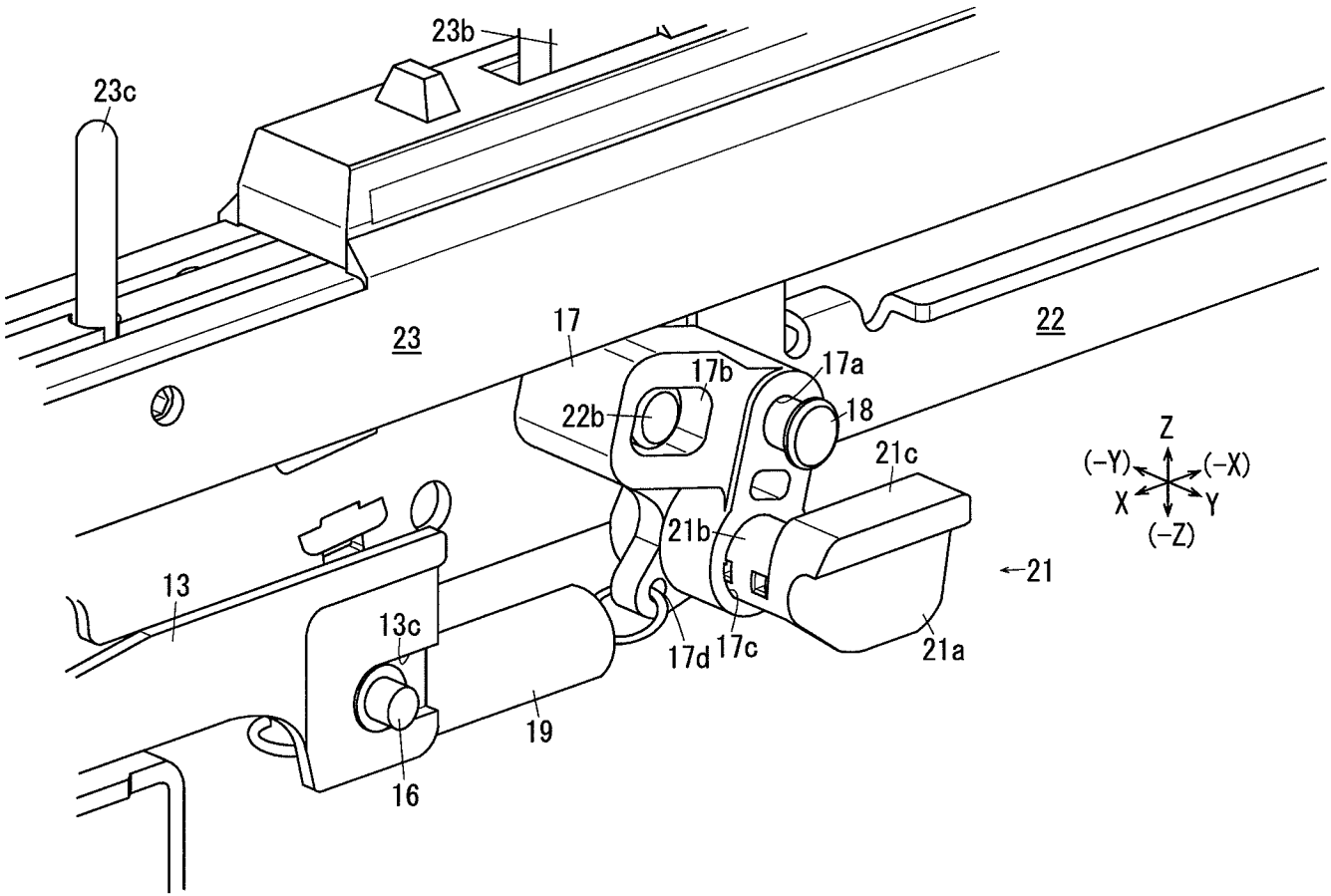
FIG. 10 is an enlarged view of main portions of an interlocking contacting member of the latent-image forming device in Example 1.

FIG. 10 is an enlarged view of main portions of an interlocking contacting member of the latent-image forming device in Example 1.

Figure 11A:
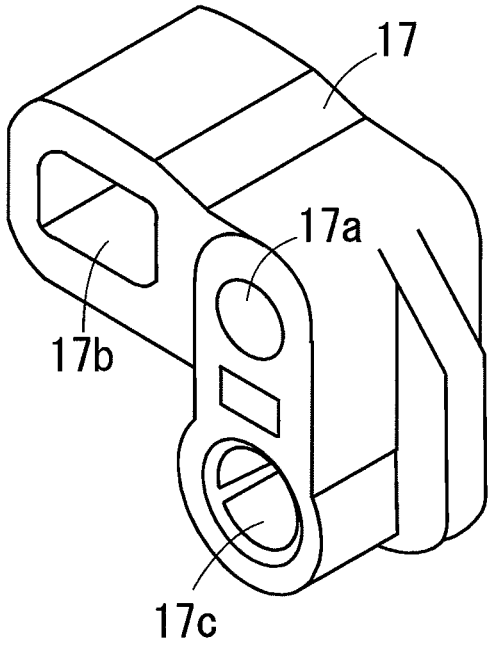
FIG. 11A is a perspective view.
Figure 11B:
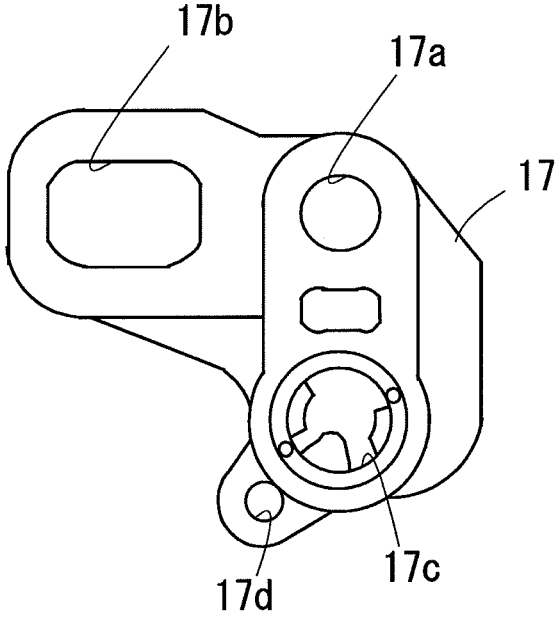
FIG. 11B is a side view.

FIG. 11 is a view illustrating a movement direction changing member of the latent-image forming device in Example 1, FIG. 11A is a perspective view, and FIG. 11B is a side view.

Referring to FIG. 7, inside the moving member 14, a pair of front and rear movement direction changing members 17 are placed correspondingly with the direction changing swing shaft passing portions 14*c*. In each of the movement direction changing members 17, a direction changing swing shaft supporting portion 17*a* is formed in an upper rear portion, and swingably supported by a direction changing swing shaft 18 which is passed through the direction changing swing shaft passing portion 14*c* configured by the oblong hole, and which is supported by the swing shaft supporting portion 11*g* of the outer frame member 11. Namely, the movement direction changing member 17 is supported so as to be swingable with respect to the outer frame member 11 with setting the direction changing swing shaft 18 as the swing center. In Example 1, the direction changing swing shafts 18 are passed through the direction changing swing shaft passing portions 14*c* configured by the oblong holes, respectively. When the moving member 14 is relatively moved in the front or rear direction with respect to the outer frame member, therefore, the movement range of the moving member 14 is restricted by the direction changing swing shafts 18 and the direction changing swing shaft passing portions 14*c* as shown in FIG. 7.

Referring to FIGS. 10 and 11, an approaching/separating member coupling portion 17*b* configured by an oblong hole which extends in the front and rear directions is formed in an upper front portion of each of the movement direction changing members 17, and an interlocking contacting member supporting portion 17*c* is formed in a lower rear portion of the movement direction changing member 17. An urging member other end supporting portion 17*d* is formed in an obliquely lower front side of the interlocking contacting member supporting portion 17*c*. Referring to FIGS. 5 and 10, an urging spring 19 which is an example of a latent-image forming device urging member is attached between the urging member end supporting portion 11*d* of the outer frame member 11 and the urging member other end supporting portion 17*d*. The urging spring 19 exerts a force of always pulling the urging member other end supporting portion 17*d* toward the urging member end supporting portion 11*d*. Namely, the movement direction changing member 17 is urged by the urging spring 19 in a direction along which the approaching/separating member coupling portion 17*b* is upward swung about the direction changing swing shaft 18.

Figure 12A:
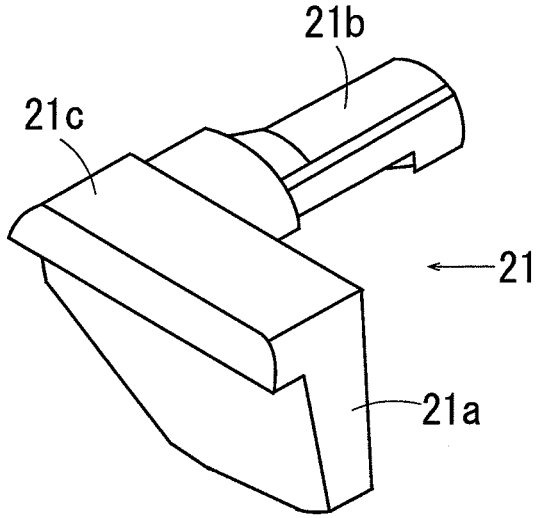
FIG. 12A is a perspective view.
Figure 12B:
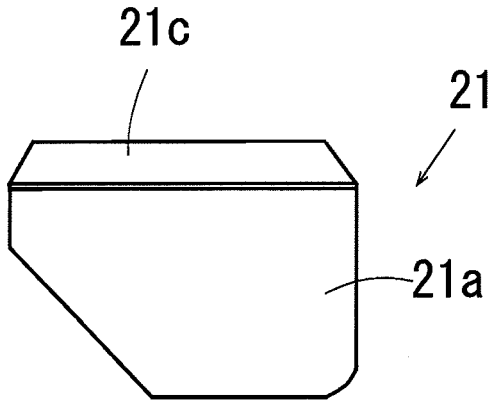
FIG. 12B is a side view.

FIG. 12 is a view illustrating the interlocking contacting member disposed in the latent-image forming device in Example 1, FIG. 12A is a perspective view, and FIG. 12B is a side view.

Referring to FIGS. 7 and 10, the interlocking contacting member 21 is supported by the interlocking contacting member supporting portion 17*c* of the movement direction changing member 17. Referring to FIG. 12, the interlocking contacting member 21 has: a trapezoidal contacting member body 21*a*; a supported portion 21*b* which rearward extends from the rear face of the contacting member body 21*a*; and an interlocking contacting portion 21*c* which is formed integrally with an upper portion of the contacting member body 21*a*. The supported portion 21*b* is unswingably attached to the interlocking contacting member supporting portion 17*c* in a state where the supported portion is passed through the interlocking contacting member outer passing portion 11*f* of the outer frame member 11 and the interlocking contacting member inner passing portion 14*b* of the moving member 14. Therefore, the interlocking contacting member 21 is configured so as to be swingable integrally with the movement direction changing member 17. In Example 1, the supported portion 21*b* is configured in a rotation shaft-like shape, and has a diameter which is smaller than the diameters of the interlocking contacting member outer passing portion 11*f* and the interlocking contacting member inner passing portion 14*b*, so that the supported portion is passed with play therethrough.

When, in accordance with movement of the moving member 14, the interlocking contacting member inner passing portion 14*b* is contacted with the supported portion 21*b*, and the moving member 14 is further moved, therefore, the approaching/separating member coupling portion 17*b* of the movement direction changing member 17 is downward swung against the urging force of the urging spring 19. In the normal state, the supported portion 21*b* which is swung integrally with the movement direction changing member 17 forward pushes the interlocking contacting member inner passing portion 14*b* by means of the urging force of the urging spring 19, and hence the coupling shaft 16 is moved toward the shaft coupling recess 13*b* so that the coupling between the operation coupling member 13 and the moving member 14 is held.

Referring to FIG. 3A, the contacting member body 21*a* and the interlocking contacting portion 21*c* of the interlocking contacting member 21 are placed outside the outer frame member 11 and on the side of the developing device Gy, and the interlocking contacting portion 21*c* is placed below the interlocking contacted member 8 which extends from the developing device Gy.

The interlocking mechanism (8+21) in Example 1 is configured by the interlocking contacting member 21 and the interlocking contacted member 8.

Figures 13A, 13B, 13C:
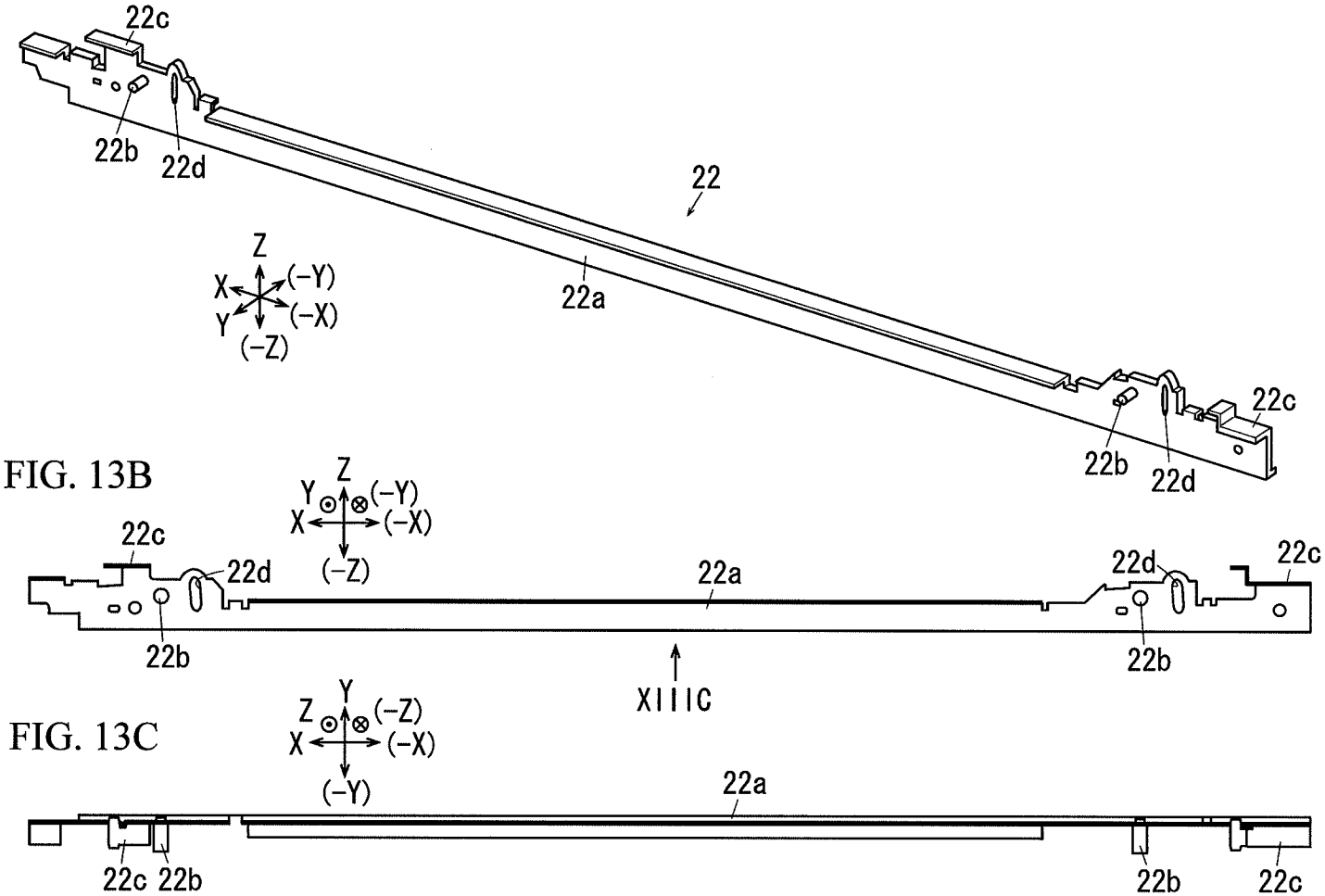
FIG. 13A is a perspective view.
FIG. 13B is a side view.
FIG. 13C is a plan view.

FIG. 13 is a view illustrating an approaching/separating member of the latent-image forming device in Example 1, FIG. 13A is a perspective view, FIG. 13B is a side view, and FIG. 13C is a plan view.

Referring to FIGS. 7 and 10, the approaching/separating member 22 is placed in the left of the movement direction changing member 17. Referring to FIG. 13, the approaching/separating member 22 has an approaching/separating member body 22*a* which extends in the front and rear directions. In both front and rear end portions of the approaching/separating member body 22*a*, coupling members 22*b* which protrude toward the movement direction changing member 17 are supported at positions corresponding to the approaching/separating member coupling portions 17*b* of the movement direction changing member 17, respectively. Each of the coupling members 22*b* is coupled to the approaching/separating member coupling portion 17*b* which is configured by an oblong hole, in a loosely fitted state. When, in accordance with swing of the movement direction changing member 17, a face of the approaching/separating member coupling portion 17*b* is contacted with the coupling members 22*b*, the approaching/separating member is pushed and moved vertically, i.e., in a direction along which the member is approached to or separated from the image carrier PRy. Light irradiating unit supporting portions 22*c* are formed in the upper faces of front and rear end portions of the approaching/separating member 22. Escape holes 22*d* respectively configured by oblong holes which extend in the vertical direction are formed in the right side of the light irradiating unit supporting portions 22*c*. The escape holes 22*d* allow the inner ends of the direction changing swing shafts 18 to escape.

Figure 14A:
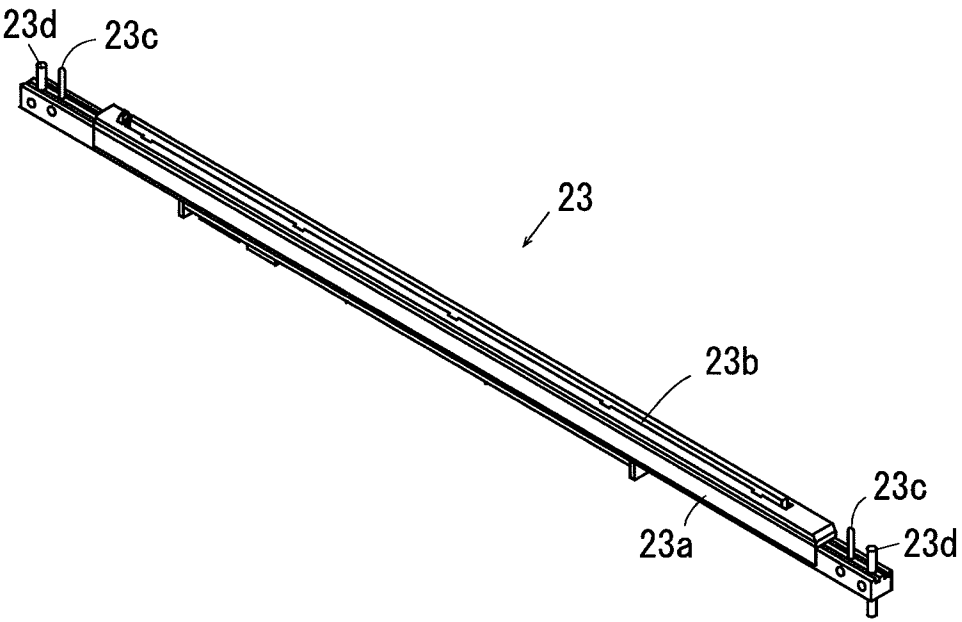
FIG. 14A is a perspective view.
Figure 14B:
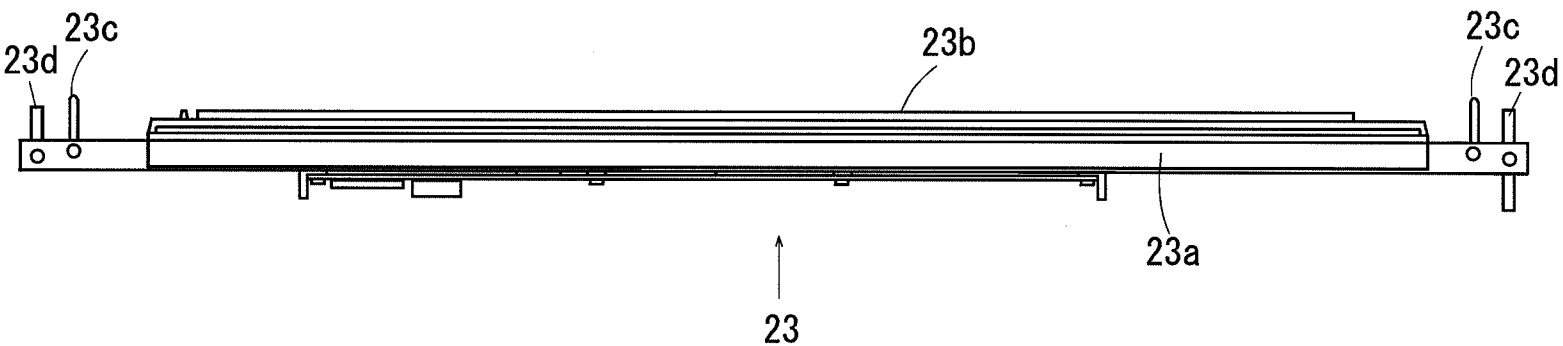
FIG. 14B is a side view.

FIG. 14 is a view illustrating an image writing beam irradiating unit of the latent-image forming device in Example 1, FIG. 14A is a perspective view, and FIG. 14B is a side view.

Referring to FIGS. 7 and 10, the image writing beam irradiating unit 23 is supported by the light irradiating unit supporting portions 22*c* of the approaching/separating member 22. The image writing beam irradiating unit 23 has an irradiating unit body 23*a* which extends in the front and rear directions, and a light irradiating portion 23*b* which is supported by the irradiating unit body 23*a*, and which is placed oppositely to the image carrier PRy to emit a latent-image writing beam. In the light irradiating portion 23*b* in Example 1, light sources which are used for forming a latent image in the surface of the image carrier PRy are arranged in the axial direction of the image carrier PRy, or namely in the main scanning direction. The light irradiating portion 23*b* is configured by a so-called LED array.

Figure 15A:
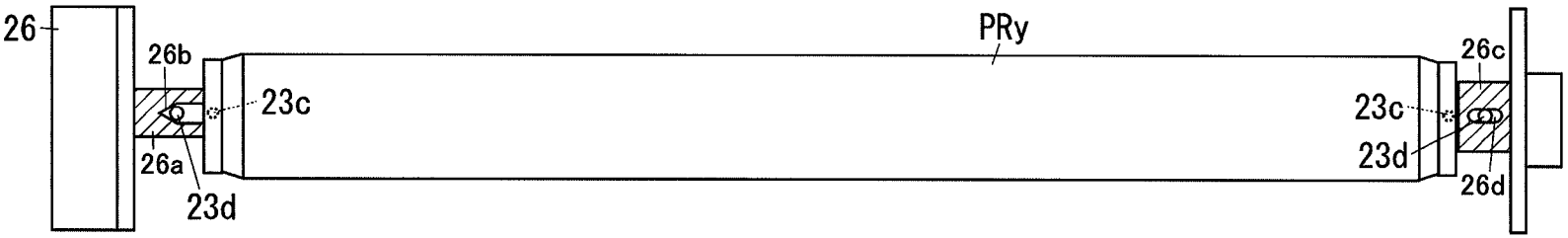
FIG. 15A is a top view.
Figure 15B:
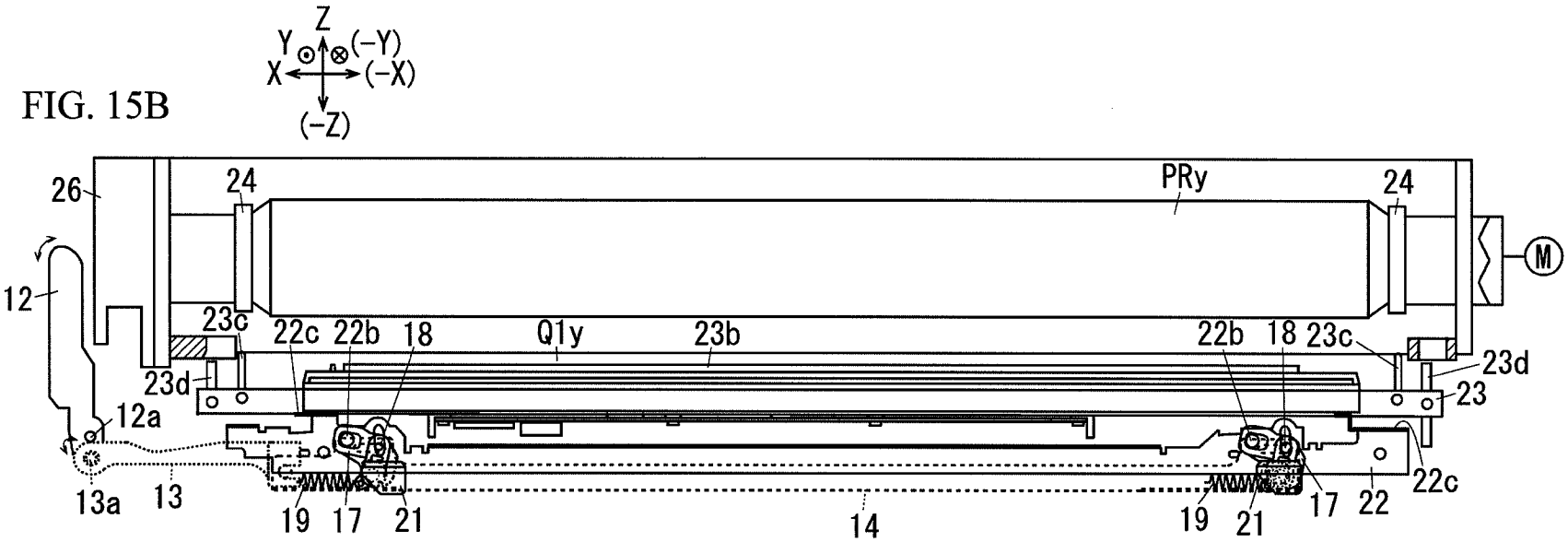
FIG. 15B is a side view.

FIG. 15 is a view illustrating the positional relationship of the image carrier in Example 1 and the latent-image forming device, FIG. 15A is a top view, and FIG. 15B is a side view.

Referring to FIGS. 6, 14, and 15, butting portions 23*c* which upward protrude are formed in front and rear end portions of the irradiating unit body 23*a*, and a pair of front and rear positioning portions 23*d* which upward protrude are formed in the front and rear sides of the butting portions 23*c*, respectively. Referring to FIG. 15, the butting portions 23*c* is butted against bearing members 24 placed in both end portions of the image carrier PRy, to be vertically positioned. Referring to FIG. 15, when the latent-image forming device LHy is moved from the latent-image forming device separating position shown in FIG. 15B to the latent-image forming device contacting position, the front positioning portion 23*d* is passed through a positioned groove 26*b* formed in a front positioned portion 26*a* supported by a front end portion of a image carrier supporting frame member 26, and the rear positioning portion 23*d* is passed through a positioned oblong hole 26*d* formed in a rear positioned portion 26*c* supported by a rear end portion of the image carrier supporting frame member 26, so that the latent-image forming device LHy is positioned in the front, rear, right, and left directions with respect to the image carrier PRy.

According to the configuration, at the latent-image forming device contacting position shown in FIG. 6A, the positional relationship of the light irradiating portion 23*b* and the surface of the image carrier PRy is held to a predetermined one, or correctly held so that the latent-image writing beam emitted from the light irradiating portion 23*b* is focused on the surface of the image carrier PRy.

In the image forming apparatus U of Example 1, as shown in FIG. 3A, the image carrier PRy and the intermediate transfer belt B are contacted with each other on an extension of a phantom line 27 which connects the light irradiating portion 23*b* with the center of the image carrier PRy, and the primary transferring device T1*y* is placed at a position which is deviated toward the downstream side in the rotation direction of the intermediate transfer belt B.

The latent-image forming device contacting/separating mechanism (11 to 22) in Example 1 is configured by the outer frame member 11, the operating member 12, the operation coupling member 13, the moving member 14, the shafts 16, 18, the movement direction changing member 17, the urging spring 19, the supported portion 21*b*, the approaching/separating member 22, etc.

(Function of Example 1)

In the image forming apparatus U of Example 1 having the above-described configuration, as shown in FIGS. 3A and 6A, the moving member 14 is forward held through the movement direction changing member 17 by the urging force of the urging spring 19 in the state where the operating member 12 is moved to the normal position which is in the upper side. Therefore, the approaching/separating member 22 is held to the upper side, and the light irradiating portion 23*b* of the image writing beam irradiating unit 23 is held in a state where a predetermined gap is formed between the portion and the image carrier PRy. Namely, the latent-image forming device LHy having the members 12 to 23 is held at the latent-image forming device contacting position to be set to a state where a latent image can be formed. The developing device Gy is held by the developing device urging member 7, at the developing device contacting position where the device is approached and opposed with respect to the image carrier PRy while forming a predetermined gap. At this time, the interlocking contacting portion 21*c* and the interlocking contacted member 8 are held in a state where the members are separated from each other, whereby vibrations produced by the rotation driving of the developer holding member 4 of the developing device Gy during an image forming operation are prevented from being transmitted to the latent-image forming device LHy, so that the latent image formation is correctly performed by the latent-image forming device LHy.

(Description of Operation of Separating Latent-Image Forming Device and Developing Device)

Figures 16A, 16B, 16C:
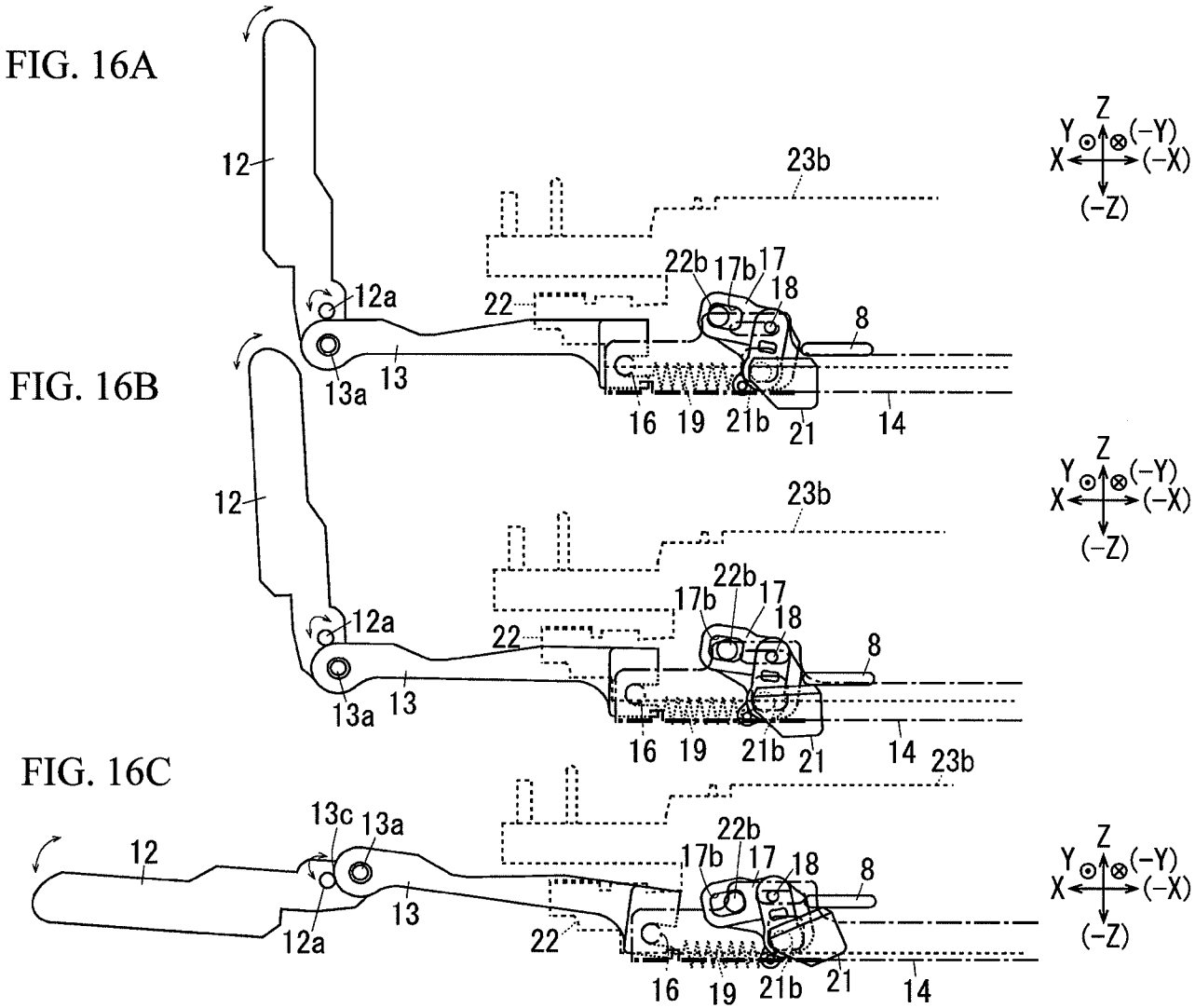
FIG. 16A is a view illustrating a state immediately after the movement of the operating member from the normal position to the insertion/extraction enabled position is started.
FIG. 16B is a view illustrating a state where the operating member is further moved from the state shown in FIG. 16A toward the insertion/extraction enabled position.
FIG. 16C is a view illustrating a state where the operating member is moved to the insertion/extraction enabled position.

FIG. 16 is a view illustrating a function in the case where the latent-image forming device and the developing device in Example 1 are to be separated from the image carrier, FIG. 16A is a view illustrating a state immediately after the movement of the operating member from the normal position to the insertion/extraction enabled position is started, FIG. 16B is a view illustrating a state where the operating member is further moved from the state shown in FIG. 16A toward the insertion/extraction enabled position, and FIG. 16C is a view illustrating a state where the operating member is moved to the insertion/extraction enabled position.

In the case where the image carrier PRy is to be replaced because of abrasion, deterioration, failure, or the like, the operating member 12 is first swung because movement of the image carrier PRy is restricted by the operating member 12. Referring to FIGS. 16A and 16B, the swing of the operating member 12 about the swing shaft member 12*a* causes the operation coupling member 13 which is coupled to the operating member by the swung supporting portion 13*a*, to be moved so as to be rearward pushed. The movement of the operation coupling member 13 causes the moving member 14 to be rearward moved through the coupling shaft 16. In conjunction with the rearward movement of the moving member 14, the interlocking contacting member inner passing portions 14*b* of the moving member 14 is contacted with the supported portion 21*b* of the interlocking contacting member 21, and the supported portion 21*b* is rearward moved. As a result, the movement direction changing member 17 to which the supported portion 21*b* is coupled is swung about the direction changing swing shaft 18 against the urging force of the urging spring 19.

At this time, as shown in FIGS. 16A and 16B, when the movement direction changing member 17 is swung and the play with respect to the coupling member 22*b* of the approaching/separating member 22 is eliminated, the swinging operation is started, and the approaching/separating member coupling portion 17*b* pushes down the coupling member 22*b*. In accordance with the downward movement of the coupling member 22*b*, the approaching/separating member 22 begins to be lowered, and starts movement in the direction along which the image writing beam irradiating unit 23 is separated from the image carrier PRy. By contrast, the interlocking contacting member 21 which is swung integrally in accordance with the swing of the movement direction changing member 17 is swung, and contacted with the interlocking contacted member 8 which has been separated therefrom.

Referring to FIGS. 16B and 16C, when the operating member 12 is further swung and the movement direction changing member 17 is swung, the interlocking contacting member 21 is contacted with and pushes up the interlocking contacted member 8, and the developing device Gy begins to be moved in the direction along which the developing device is separated from the image carrier PRy about the swing shaft 6 against the urging force of the developing device urging member 7.

Referring to FIGS. 3B, 6B, and 16C, when the operating member 12 is moved to the insertion/extraction enabled position, the latent-image forming device LHy is moved to the latent-image forming device separating position where the device is separated from the image carrier PRy, and the developing device Gy is moved to the developing device separating position where the device is separated from the image carrier PRy. In this state, the image carrier PRy can be extracted or inserted without causing the surface to be contacted with the latent-image forming device LHy or the developing device Gy. At his time, the swing shaft member 12*a* of the operating member 12 exceeds the dead center 13*c*. By the urging force of the urging spring 19, therefore, the operation coupling member 13 is subjected to a forward pushing force, and the operating member 12 naturally receives a force of moving the member to the lower side of the operation coupling member 13. Consequently, the operating member 12 is automatically held to the insertion/extraction enabled position unless the user applies a force to move the member toward the normal position.

(Description of Operation of Approaching Latent-Image Forming Device and Developing Device)

Figure 17A:
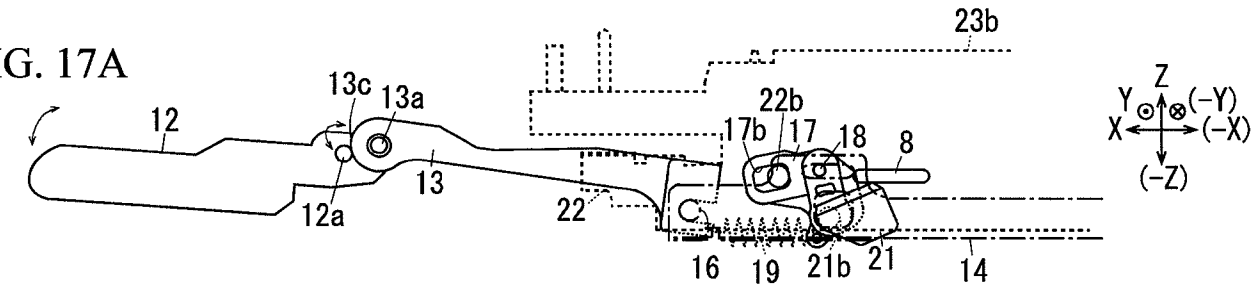
FIG. 17A is a view illustrating a state where the operating member is moved to the insertion/extraction enabled position.
Figure 17B:
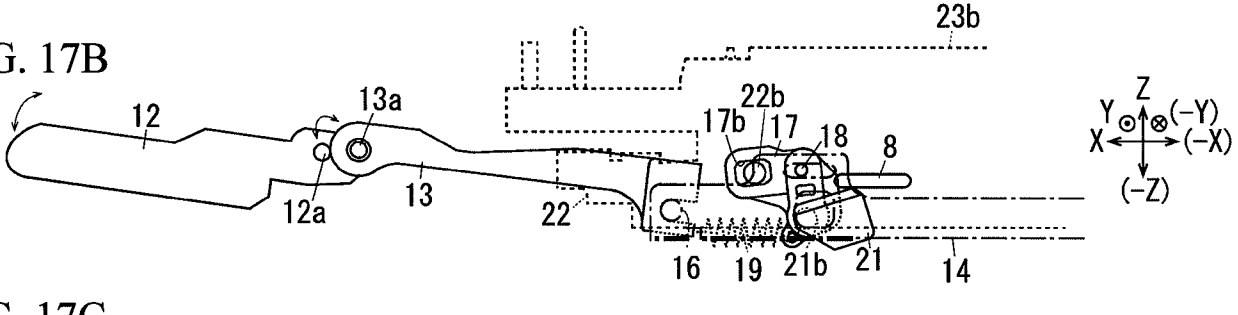
FIG. 17B is a view illustrating a state immediately after the movement of the operating member from the state shown in FIG. 17A toward the normal position is started.
Figure 17C:
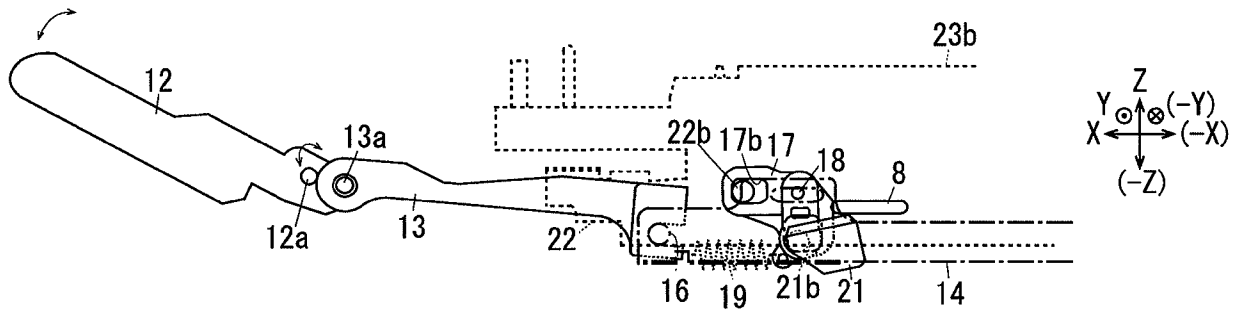
FIG. 17C is a view illustrating a state where the operating member is further moved from the state shown in FIG. 17B toward the normal position.

FIG. 17 is a view illustrating a function in the case where the latent-image forming device and the developing device in Example 1 are to be approached to the image carrier, FIG. 17A is a view illustrating a state where the operating member is moved to the insertion/extraction enabled position, FIG. 17B is a view illustrating a state immediately after the movement of the operating member from the state shown in FIG. 17A toward the normal position is started, and FIG. 17C is a view illustrating a state where the operating member is further moved from the state shown in FIG. 17B toward the normal position.

Referring to FIG. 17, when the replacement of the image carrier PRy is completed, the operating member 12 is returned from the insertion/extraction enabled position to the normal position. At this time, when the operating member 12 begins the movement, the shaft coupling recess 13*b* of the operation coupling member 13 is moved in the direction along which it is separated from the coupling shaft 16, but the moving member 14 is forward moved by the urging force of the urging spring 19, so that the coupling of the operation coupling member 13 and the moving member 14 is held. In accordance with the forward movement of the moving member 14, the interlocking contacting member inner passing portions 14*b* is contacted with the supported portion 21*b* of the interlocking contacting member 21, and the supported portion 21*b* is forward moved. Therefore, also the movement direction changing member 17 to which the supported portion 21*b* is coupled is swung about the direction changing swing shaft 18.

At this time, the approaching/separating member coupling portion 17*b* is fitted with play into the coupling member 22*b* as shown in FIG. 17B, and hence the approaching/separating member 22 is not substantially moved unless the play is eliminated. By contrast, the interlocking contacting member 21 which is swung integrally in accordance with the swing of the movement direction changing member 17 is swung to begin to be moved in the direction along which it is separated from the interlocking contacted member 8. When the interlocking contacting member 21 is moved in the direction along which it is separated from the interlocking contacted member 8, the developing device Gy is caused by the urging force of the developing device urging member 7 of the developing device Gy to begin the movement in the direction along which the device is approached to the image carrier PRy about the swing shaft 6.

Referring to FIG. 17C, when the operating member 12 is further swung and the movement direction changing member 17 is swung, the play between the approaching/separating member coupling portion 17*b* and the coupling member 22*b* is eliminated, and the approaching/separating member coupling portion 17*b* pushes up the coupling member 22*b*. In accordance with the upward movement of the coupling member 22*b*, the approaching/separating member 22 begins to be upward moved, and the image writing beam irradiating unit 23 begins to be moved in the direction along which it is approached to the image carrier PRy.

In accordance with the movement of the operating member 12 to the normal position, the developing device Gy and the latent-image forming device LHy are approached to the image carrier PRy. When the developing device Gy is caused by the developing device urging member 7 to be butted against the image carrier PRy, the developing container 1 is not further swung, and the pressing of the developing device urging member 7 against the interlocking contacting member 21 of the interlocking contacted member 8 is canceled. Namely, the developing device Gy is held to the state where the device is moved to the developing device contacting position. When the interlocking contacting member 21 and the interlocking contacted member 8 begin to be separated from each other, the butting portions 23*c* of the latent-image forming device LHy are in the state before they are butted against the bearing members 24.

Referring to FIG. 6B, when, after the developing device Gy is moved to the developing device contacting position, the operating member 12 is further swung to be moved to the normal position, the moving member 14 is forward moved by the urging force of the urging spring 19, and the movement direction changing member 17 is further swung. In accordance with this, the interlocking contacting member 21 and the interlocking contacted member 8 are separated from each other. At this time, the butting portions 23*c* of the latent-image forming device LHy are butted against the bearing members 24, the latent-image forming device LHy is moved to the latent-image forming device contacting position, and the pair of front and rear positioning portions 23*d* are fitted respectively into the positioned groove 26*b* and the positioned oblong hole 26*d*, thereby performing the positioning.

Figure 18:
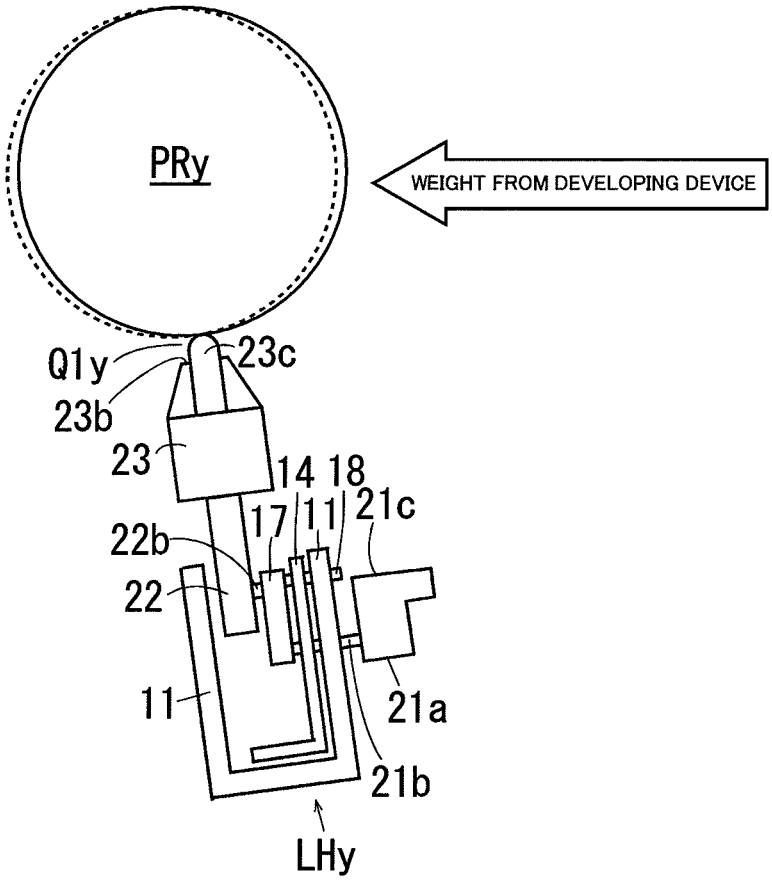
FIG. 18 is a view illustrating the positional relationship of the image carrier and the latent-image forming device in Example 1.

FIG. 18 is a view illustrating the positional relationship of the image carrier and the latent-image forming device in Example 1.

In Example 1, as indicated by the solid line in FIG. 18, the latent-image forming device LHy is butted in the state where the developing device Gy is butted against the image carrier PRy, and then the positioning is performed. In the case where, after the latent-image forming device LHy is positioned with respect to the image carrier PRy, the developing device Gy is butted against the image carrier PRy as indicated by the broken line in FIG. 18, failures such as that the position of the latent-image forming device LHy is deviated with respect to the image carrier PRy, and the gap between the latent-image forming device LHy and the image carrier PRy is changed to a small value, or the latent-image forming device LHy is inclined with respect to the image carrier PRy are prevented from occurring.

Example 1 is configured so that, when the image carrier PRy is to be replaced, the intermediate transfer belt B and the primary transferring device T1*y* are approached or separated with respect to the image carrier PRy, and moved independently from the approach and separation of the latent-image forming device LHy and the developing device Gy. In Example 1, in a state where the latent-image forming device LHy and the developing device Gy are moved to their respective contacting positions, the primary transferring device T1*y* can be approached or separated with respect to the image carrier PRy. In Example 1, at this time, the primary transferring device T1*y* is placed at the position which is deviated toward the downstream side with respect to the contacting position of the image carrier PRy and the intermediate transfer belt B, so that, even when the primary transferring device T1*y* is approached to or separated from the image carrier PRy, the device is not pressed against the image carrier PRy. Even when, after the latent-image forming device LHy is positioned with respect to the image carrier PRy, the primary transferring device T1*y* is moved from a transferring device separating position to a transferring device contacting position, therefore, the position of the image carrier PRy is not changed, and the positional relationship of the latent-image forming device LHy and the image carrier PRy is held to a correct one.

Example 2

Next, Example 2 of the invention will be described. In the description of Example 2, the components corresponding to those of Example 1 are denoted by the same reference numerals, and their detailed description will be omitted.

Example 2 is configured in the same manner as Example 1 except the following points.

Figure 19A:
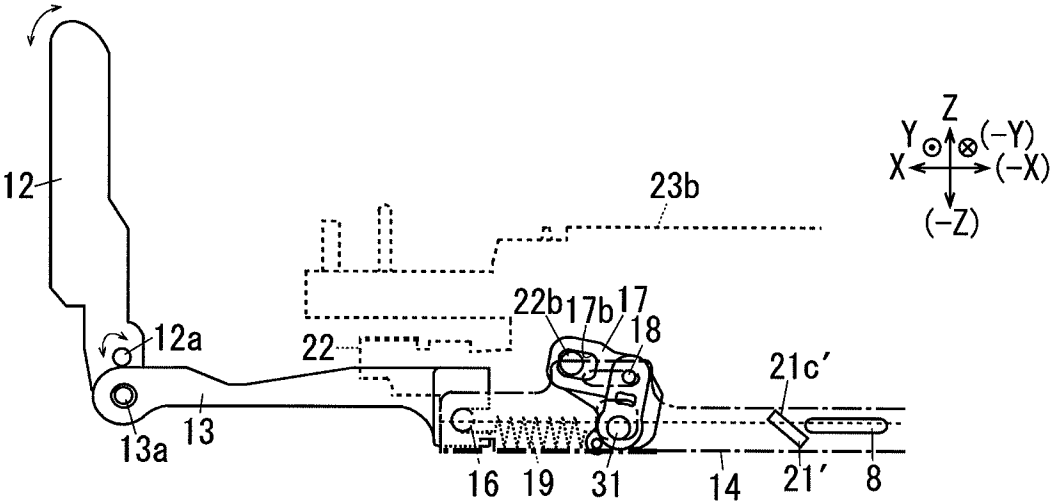
FIG. 19A is a view corresponding to FIG. 6A of Example 1.
Figure 19B:
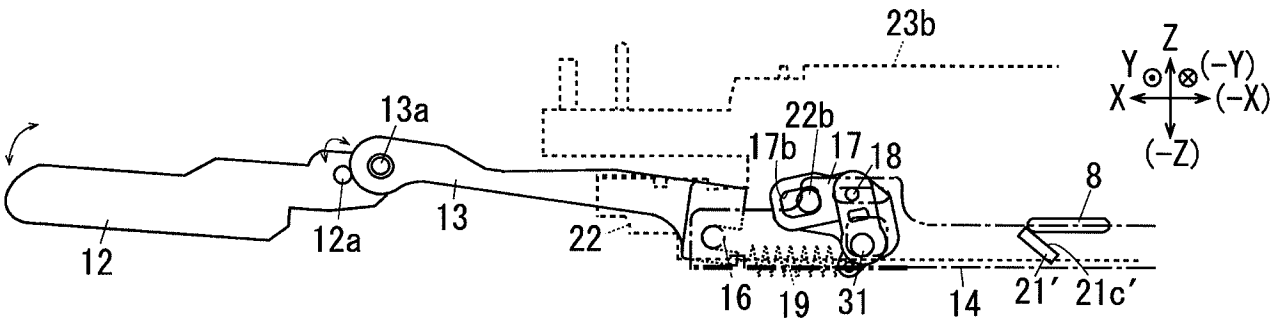
FIG. 19B is a view corresponding to FIG. 6B of Example 1.

FIG. 19 is a view illustrating a latent-image forming device in Example 2, FIG. 19A is a view corresponding to FIG. 6A of Example 1, and FIG. 19B is a view corresponding to FIG. 6B of Example 1.

Referring to FIG. 19, in the latent-image forming device Lhy' in Example 2, the interlocking contacting member 21 in Example 1 is omitted, and a movement coupling member 31 which corresponds to the supported portion 21*b*, and through which the moving member 14 and the movement direction changing member 17 are coupled to each other is disposed. An interlocking contacting member 21' which is passed through the outer frame member 11 to protrude toward the developing device at a position deviated from the interlocking contacting member 21 in Example 1 in the front and rear directions is formed integrally with the moving member 14. The interlocking contacting member 21' has a contacting portion 21*c'* which is more downward inclined as further rearward advancing.

In Example 2, in correspondence with the position of the interlocking contacting member 21', also the interlocking contacted member 8 is placed at a position which is rearward deviated as compared with the case of Example 1. In Example 2, as shown in FIG. 19A, the interlocking contacting member 21' and the interlocking contacted member 8 are held in a state where they are separated from each other in the front and rear directions, and, at the latent-image forming device separating position, the contacted member 8 is set so as to be held to a state where the member is pushed up by the inclined interlocking contacting member 21' as shown in FIG. 19B.

Although not illustrated, the interlocking contacting member outer passing portion 11*f* is formed so as to extend in the front and rear directions along the movement direction of the moving member 14 as compared with the case of Example 1.

The interlocking mechanism in Example 2 is configured by the interlocking contacting member 21', the interlocking contacted member 8, and the like. The latent-image forming device contacting/separating mechanism in Example 2 is configured by the movement coupling member 31 in addition to the moving member 14, the movement direction changing member 17, and the like.

(Function of Example 2)

In the image forming apparatus U of Example 2 having the above-described configuration, the moving member 14 is moved in the front and rear directions in interlocking with the swinging movement of the operating member 12, the approaching/separating member 22 is moved up and down through the movement direction changing member 17 coupled to the moving member 14 by the movement coupling member 31, and the image writing beam irradiating unit 23 is approached and separated with respect to the image carrier PRy.

When the operating member 12 is moved from the normal position to the insertion/extraction enabled position, the contacting portion 21*c'* is contacted with the interlocking contacted member 8 in accordance with the rearward movement of the moving member 14, and the interlocking contacted member is pushed up by the inclined face, whereby the developing device Gy is moved to the developing device separating position. Also in Example 2, the gap between the interlocking contacting member 21' and the interlocking contacted member 8 at the latent-image forming device contacting position, the degree of the play between the approaching/separating member coupling portion 17*b* and the coupling member 22*b*, and the like are set so that the developing device Gy can be butted before the latent-image forming device LHy is butted against the image carrier PRy.

Example 3

Next, Example 3 of the invention will be described. In the description of Example 3, the components corresponding to those of Examples 1 and 2 are denoted by the same reference numerals, and their detailed description will be omitted.

Example 3 is configured in the same manner as Examples 1 and 2 except the following points.

Figure 20A:
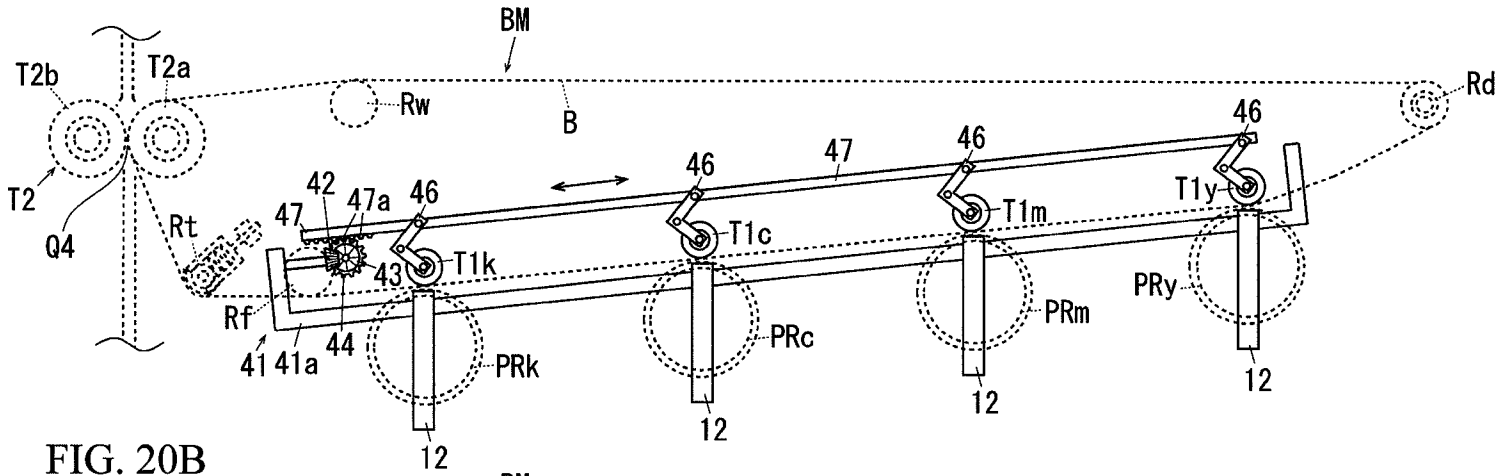
FIG. 20A is a diagram of a state where the components are at a transferring device contacting position and the latent-image forming device contacting position.
Figure 20B:
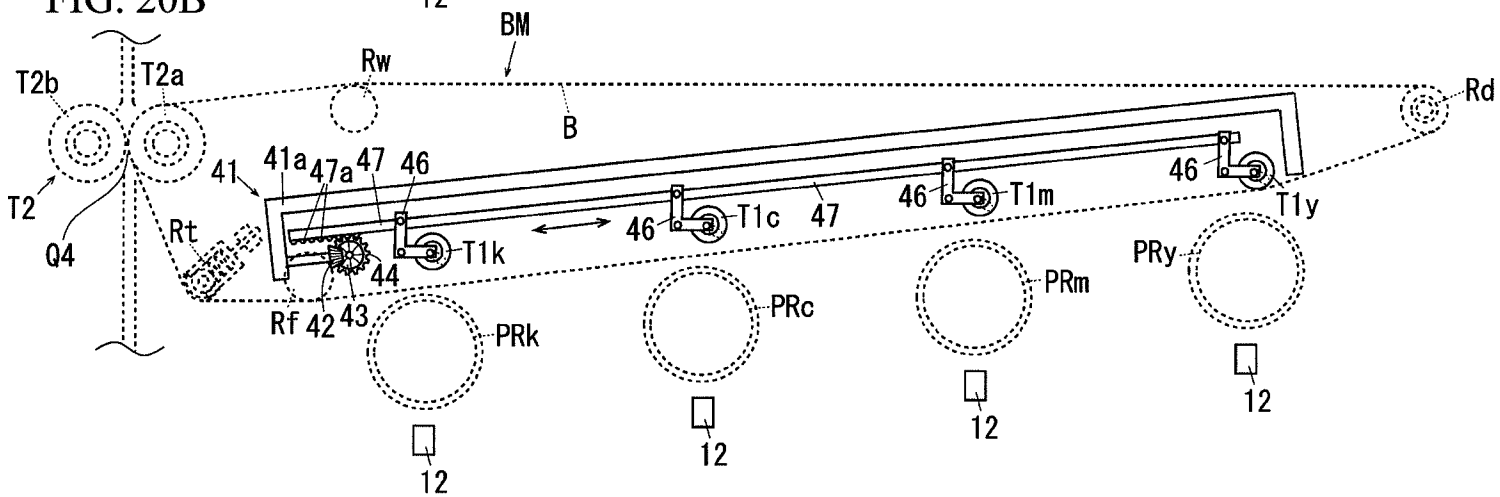
FIG. 20B is a diagram of a state where the components are at a transferring device separating position and the latent-image forming device separating position.

FIG. 20 is a diagram of the image forming apparatus of Example 3, FIG. 20A is a diagram of a state where the components are at the transferring device contacting position and the latent-image forming device contacting position, and FIG. 20B is a diagram of a state where the components are at the transferring device separating position and the latent-image forming device separating position.

Figure 21:
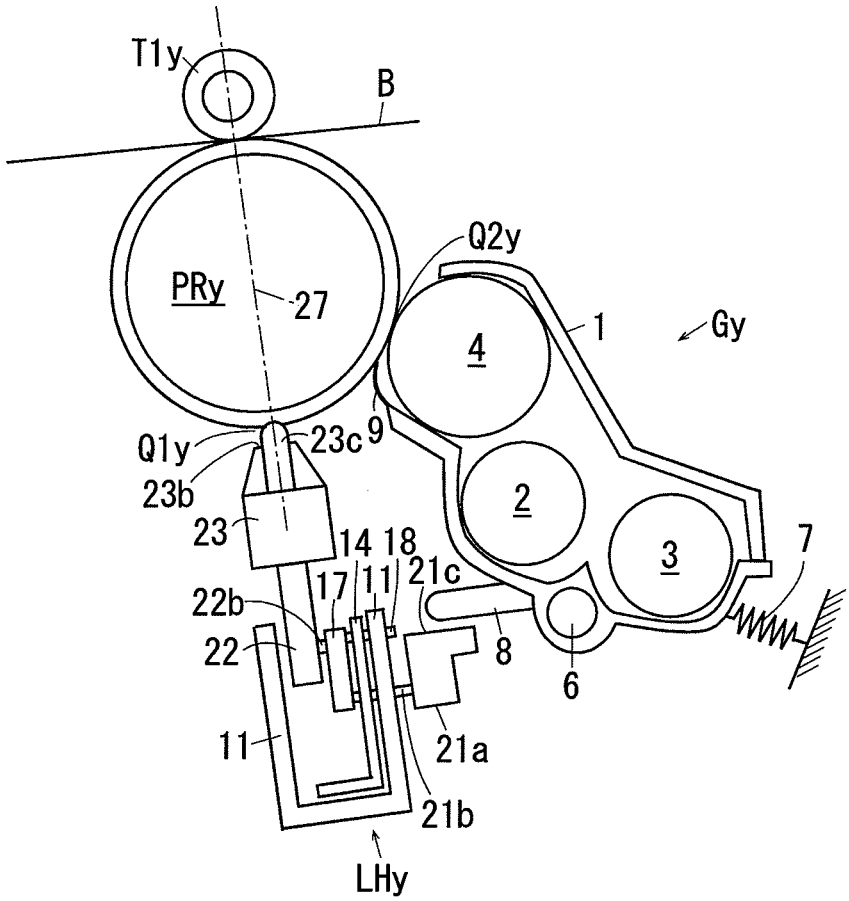
FIG. 21 is a view which illustrates the positional relationship of the image carrier, the latent-image forming device, and the primary transferring device in Example 3, and which corresponds to FIG. 3A in Example 1.

FIG. 21 is a view which illustrates the positional relationship of the image carrier, the latent-image forming device, and the primary transferring device in Example 3, and which corresponds to FIG. 3A in Example 1.

Referring to FIG. 20, in the image forming apparatus U of Example 3, a transferring device approaching/separating operating member 41 is swingably supported by the front end wall of the frame member, or the frame of the belt module BM. The transferring device approaching/separating operating member 41 has a grip portion 41*a* which is to be gripped and operated by the user, and which extends in the right and left directions, and is configured so that, when the grip portion is gripped and the transferring device approaching/separating operating member 41 is operated, the member can be moved between the normal position shown in FIG. 20A and the insertion/extraction enabled position shown in FIG. 20B. A bevel gear 42 is supported by a rotation shaft 41*a* of the transferring device approaching/separating operating member 41. The bevel gear 42 meshes with a driven bevel gear 43 placed in the belt module BM, and an approaching/separating gear 44 is supported coaxially with the driven bevel gear 43.

One end portions 46*a* of movement direction changing members 46 are coupled to the primary transferring devices T1*y* to T1*k*, respectively. The one end portions 46*a* are configured so as to be guided in directions along which the portions are approached and separated with respect to the image carriers PRy to PRk, by guiding portions which are formed on the frame member of the belt module BM, and which are not shown. Each of the movement direction changing members 46 is formed into an inverted L-like shape. The other end portions 46*b* of the movement direction changing members 46 are swingably coupled to a moving member 47 which is supported by the frame member of the belt module BM so as to be movable in the right and left directions. A gear portion 47*a* which meshes with the approaching/separating gear 44 is formed in a right end portion of the moving member 47.

A transferring device approaching/separating mechanism in Example 3 is configured by the members denoted by the reference numerals 41 to 47.

Referring to FIG. 20, the transferring device approaching/separating operating member 41 is placed at a position where insertion and extraction of the image carriers PRy to PRk are restricted at the normal position. The grip portion 41*a* of the transferring device approaching/separating operating member 41 is placed at a position where the portion is interposed at the normal position between the operating members 12 of the latent-image forming devices LHy to LHk and the image carriers PRy to PRk.

Referring to FIG. 21, in Example 3, the primary transferring device T1*y* is placed on the extension of the phantom line 27 with respect to the image carrier PRy. In Example 1, the weight by which the primary transferring device T1*y* is pressed against the image carrier PRy is set to be smaller than that by which the latent-image forming device LHy is pressed against the image carrier PRy.

(Function of Example 3)

In the image forming apparatus U of Example 3 having the above-described configuration, normally, the primary transferring devices T1*y* to T1*k* are held in a state where the primary transferring devices are pressed by the transferring device approaching/separating mechanism against the image carriers PRy to PRk across the intermediate transfer belt B, and a tension is applied to the intermediate transfer belt B.

In the case where the image carriers PRy to PRk are to be replaced, first, the operating members 12 of the latent-image forming devices LHy to LHk are operated to separate the latent-image forming devices LHy to LHk and the developing devices Gy to Gk from the image carriers PRy to PRk. Next, when the transferring device approaching/separating operating member 41 is moved to the insertion/extraction enabled position, the primary transferring devices T1*y* to T1*k* are separated from the image carriers PRy to PRk by the gears 42 to 44, the moving member 47, and the movement direction changing members 46, and the tension of the intermediate transfer belt B is reduced, so that the belt is separated from the image carriers PRy to PRk. In this state, the image carriers PRy to PRk can be replaced with new ones.

When the replacement of the image carriers PRy to PRk is ended, the primary transferring devices T1*y* to T1*k* are caused to be contacted with the image carriers PRy to PRk by the transferring device approaching/separating operating member 41, and then the operating members 12 are operated to approach and butt the developing devices Gy to Gk and the latent-image forming devices LHy to LHk against the image carriers PRy to PRk in this sequence. In the state where the primary transferring devices T1*y* to T1*k* and the developing devices Gy to Gk are contacted with and butted against the image carriers PRy to PRk, namely, the latent-image forming devices LHy to LHk are butted against the image carriers PRy to PRk.

Example 4

Next, Example 4 of the invention will be described. In the description of Example 4, the components corresponding to those of Example 1 are denoted by the same reference numerals, and their detailed description will be omitted.

Example 4 is configured in the same manner as Example 1 except the following points.

Figure 22A:
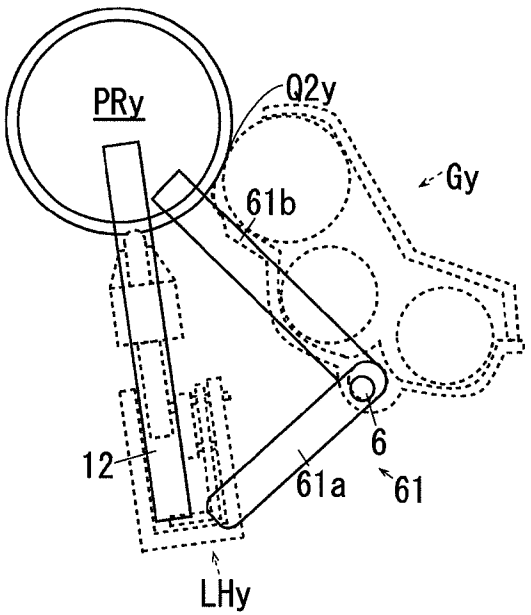
FIG. 22A is a diagram of a state where the latent-image forming device is moved to the latent-image forming device contacting position and the developing device is moved to the developing device contacting position.
Figure 22B:
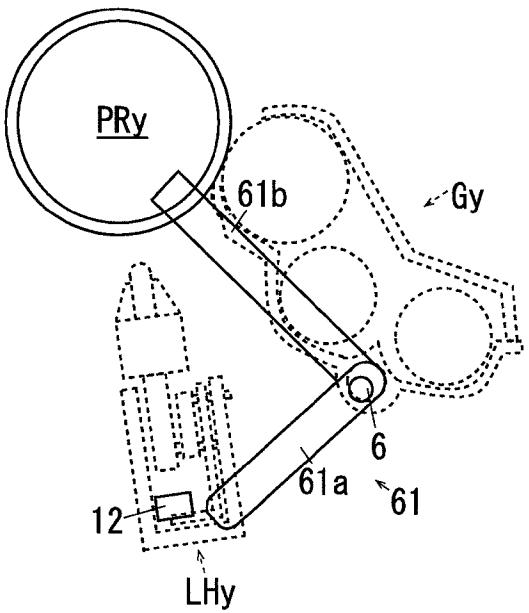
FIG. 22B is a diagram of a state where the latent-image forming device is moved to the latent-image forming device separating position and the developing device is moved to the developing device contacting position.
Figure 22C:
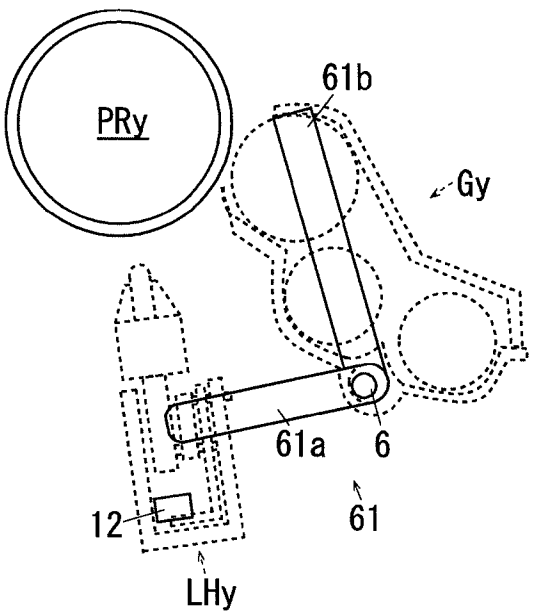
FIG. 22C is a diagram of a state where the latent-image forming device is moved to the latent-image forming device separating position and the developing device is moved to the developing device separating position.

FIG. 22 is a diagram of the image forming apparatus of Example 4, FIG. 22A is a diagram of a state where the latent-image forming device is moved to the latent-image forming device contacting position and the developing device is moved to the developing device contacting position, FIG. 22B is a diagram of a state where the latent-image forming device is moved to the latent-image forming device separating position and the developing device is moved to the developing device contacting position, and FIG. 22C is a diagram of a state where the latent-image forming device is moved to the latent-image forming device separating position and the developing device is moved to the developing device separating position.

Referring to FIG. 22, in the image forming apparatus U of Example 4, the interlocking mechanism 8+21 in Example 1 is omitted, and a developing device operating member 61 which swings the developing device Gy about the swing shaft 6 is placed in front of the developing device Gy. The developing device operating member 61 has: an operating portion body 61*a* which is to be operated by the worker; and an insertion/extraction restricting portion 61*b* which is inclined with respect to the operating portion body 61*a*, and which restricts insertion and extraction of the image carrier PRy. The developing device operating member 61 in Example 4 is swingably supported by the frame member of the developing unit so as to be movable between the normal position shown in FIGS. 22A and 22B, and the separating position shown in FIG. 22C.

In Example 4, the developing device operating member 61 is set to substantially same positions in the front and rear directions with respect to the operating members 12, and configured so that, even when the developing device operating member 61 is moved toward the separating position in the state shown in FIG. 22A, the member interferes with the operating member 12 and cannot be moved. At the separating position shown in FIG. 22C, similarly, the developing device operating member 61 enters the side of the operating member 12. Even when it is tried to move the operating member 12 toward the normal position, therefore, the member interferes with the developing device operating member 61 and cannot be moved toward the developing position.

As shown in FIGS. 22A and 22B, at the normal position, the insertion/extraction restricting portion 61*b* is placed in front of the image carrier PRy, insertion and extraction of the image carrier PRy are restricted, and, at the separating position shown in FIG. 22C, the insertion/extraction restricting portion 61*b* is retracted from the front side of the image carrier PRy, and insertion and extraction of the image carrier PRy are allowed.

The developing device contacting/separating mechanism 6+7+61 in Example 4 is configured by the swing shaft 6, the developing device urging member 7, and the developing device operating member 61.

(Function of Example 4)

In the image forming apparatus U of Example 4 having the above-described configuration, the image forming operation is performed in the state shown in FIG. 22A, and, when the image carrier PRy is to be replaced, first, the operating member 12 is operated to move the latent-image forming device LHy to the latent-image forming device separating position to attain the state shown in FIG. 22B. In the state shown in FIG. 22A, namely, the developing device operating member 61 cannot be operated without operating the operating member 12, and, in the state where the latent-image forming device LHy is moved to the latent-image forming device contacting position, the developing device Gy cannot be moved to the developing device separating position.

In the state shown in FIG. 22B, insertion and extraction of the image carrier PRy are disabled by the insertion/extraction restricting portion 61*b*, and insertion and extraction in the state where the developing device Gy is butted against the image carrier PRy are prevented from occurring.

When the developing device operating member 61 is swung in the state shown in FIG. 22B, the developing device Gy is separated from the image carrier PRy as shown in FIG. 22C, and the insertion/extraction restricting portion 61*b* is retracted from the front face of the image carrier PRy, so that the state where insertion and extraction of the image carrier PRy are enabled is obtained.

In the state shown in FIG. 22C, the operating portion body 61*a* of the developing device operating member 61 enters the side of the operating member 12, and hence the operation of the operating member 12 is restricted. Namely, it is configured so tat, in the state where the developing device Gy is moved to the developing device separating position, the latent-image forming device LHy cannot be moved to the latent-image forming device contacting position.

When the replacement of the image carrier PRy is ended, the developing device operating member 61 is operated, and then the operating member 12 is operated, whereby the developing device Gy and the latent-image forming device LHy are butted in this sequence against the image carrier PRy, and the positional accuracy of the latent-image forming device LHy is prevented from being lowered.

(Modifications)

Although, in the above, the examples of the invention have been described in detail, the invention is not restricted to the examples. Various modifications are enabled within the scope of the spirit of the invention set forth in the claims. Modifications (H01) and (H02) of the invention will be exemplified.

(H01) In the examples, a copier is exemplified as the image forming apparatus. The invention is not restricted to this. The image forming apparatus may be configured as a facsimile apparatus, a printer, or a multifunction machine having all or plural functions of such apparatuses. The image forming apparatus having the image carriers PRy to PRk, developing devices Gy to Gk, and latent-image forming devices LHy to LHk which are used for the four colors has been described. The invention is not restricted to this. The invention can be applied also to a monochrome image forming apparatus, and a rotary type image forming apparatus in which a single image carrier and a single latent-image forming device are used, and four developing devices are rotated to be sequentially opposed to the image carrier.

(H02) Example 3 is configured so that the transferring device operating member 41 is placed in the inner side with respect to the operating members 12 of the latent-image forming devices LHy to LHk. Alternatively, the operating member may be placed in the outer side. In the alternative, after the latent-image forming devices LHy to LHk are moved to the latent-image forming device contacting position, the primary transferring devices T1*y* to T1*k* are pressed against the image carriers PRy to PRk. In Example 1, the weight by which the primary transferring device T1*y* is pressed against the image carrier PRy is set to be smaller than that by which the latent-image forming device LHy is pressed against the image carrier PRy. Therefore, the positional displacements of the image carriers PRy to PRk with respect to the latent-image forming devices LHy to LHk are suppressed to the minimum level.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image carrier;

a latent-image forming device that forms a latent image in a surface of the image carrier;

a developing device that develops the latent image of the surface of the image carrier;

a latent-image forming device contacting/separating mechanism that moves the latent-image forming device between a latent-image forming device contacting position where a part of the latent-image forming device is positioned with being contacted with a part of the image carrier, and a latent-image forming device separating position where the latent-image forming device is separated from the image carrier; and a developing device contacting/separating mechanism that moves the developing device between a developing device contacting position where a part of the developing device is positioned with being contacted with a part of the image carrier, and a developing device separating position where the developing device is separated from the image carrier, wherein the developing device contacting/separating mechanism performs at least one of (iii) and (iv), wherein (iii) is that the developing device contacting/separating mechanism allows the developing device to be movable to the developing device contacting position in a state where the latent-image forming device is moved to the latent-image forming device separating position, and (iv) is that the development device contacting/separating mechanism restricts the developing device from being moved to the developing device contacting position in a state where the latent-image forming device is moved to the latent-image forming device contacting position.

2. The image forming apparatus according to claim 1, wherein the apparatus further comprises:

an image carrier unit that has the image carrier, and that is attachable and detachable with respect to a body of the image forming apparatus;

a latent-image forming device positioning portion that is disposed in the latent-image forming device, and that is to be contacted with a part of the image carrier unit to position the latent-image forming device; and a developing device positioning portion that is disposed in the developing device, and that is to be contacted with a part of the image carrier unit to position the developing device, the latent-image forming device contacting/separating mechanism moves the latent-image forming device between a latent-image forming device contacting position where the latent-image forming device positioning portion is contacted with a part of the image carrier unit, and a latent-image forming device separating position where the latent-image forming device positioning portion is separated from the part of the image carrier unit, and the developing device contacting/separating mechanism moves the developing device between a developing device contacting position where the developing device positioning portion is contacted with a part of the image carrier unit, and a developing device separating position where the developing device positioning portion is separated from the part of the image carrier unit.

3. The image forming apparatus according to claim 1, wherein the latent-image forming device contacting/separating mechanism has a moving member that is supported to be relatively movable with respect to an outer frame member of the latent-image forming device, and that is movable between the latent-image forming device contacting position and the latent-image forming device separating position, and the apparatus further comprises an interlocking mechanism having: an interlocking contacted member that is supported by the developing device; and an interlocking contacting member that is placed correspondingly with the interlocking contacted member, that is supported by the latent-image forming device contacting/separating mechanism, and that is moved in interlocking with movement of the moving member to cause the interlocking contacted member to be moved.

4. The image forming apparatus according to claim 3, wherein the interlocking contacting member is placed with being separated from and opposed to the interlocking contacted member in a state where the latent-image forming device is moved to the latent-image forming device contacting position and the developing device is moved to the developing device contacting position.

5. The image forming apparatus according to claim 1, wherein the latent-image forming device has a light irradiating portion that emits image writing light for forming the latent image, and an outer frame member, and the latent-image forming device contacting/separating mechanism has an operating member that is supported by the outer frame member, and that is movable between a normal position where insertion and extraction of the image carrier are restricted, and an insertion/extraction enabled position where insertion and extraction of the image carrier are enabled, the operating member causing, at the normal position, the latent-image forming device to be moved to the latent-image forming device contacting position, and, at the insertion/extraction enabled position, causing the latent-image forming device to be moved to the latent-image forming device separating position.

6. The image forming apparatus according to claim 5, wherein the operating member is swingably supported by the outer frame member, and is supported to be movable between the normal position and the insertion/extraction enabled position, and the latent-image forming device contacting/separating mechanism further has: a moving member that is coupled to the operating member, and that is supported to be relatively movable with respect to the outer frame member; a movement direction changing member that is coupled to the moving member, and that converts the relative movement of the moving member to swinging movement; and an approaching/separating member that is coupled to the movement direction changing member, and that supports the light irradiating portion in a manner that the light irradiating portion is approachable and separable with respect to the image carrier.

7. The image forming apparatus according to claim 6, wherein the apparatus further comprises:

a swing shaft member that is formed on the operating member; and an operation coupling member that is swingably supported by the operating member, and that is swingably supported by the moving member, a dead center of the operation coupling member being set in a path along which the swing shaft member passes with being in contact with an outer face of the operation coupling member during movement of the operating member between the insertion/extraction enabled position and the normal position.

* * * * *